US011177578B2

(12) United States Patent
Sone et al.

(10) Patent No.: US 11,177,578 B2
(45) Date of Patent: Nov. 16, 2021

(54) ANTENNA DEVICE FOR VEHICLE

(71) Applicant: YOKOWO CO., LTD., Tokyo (JP)

(72) Inventors: Takayuki Sone, Tomioka (JP); Satoshi Iwasaki, Tomioka (JP); Kazuya Matsunaga, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 34 days.

(21) Appl. No.: 16/685,484

(22) Filed: Nov. 15, 2019

(65) Prior Publication Data

US 2020/0091615 A1 Mar. 19, 2020

Related U.S. Application Data

(63) Continuation of application No. PCT/JP2018/019197, filed on May 17, 2018.

(30) Foreign Application Priority Data

May 17, 2017 (JP) ..... JP2017-098433

(51) Int. Cl.
*H01Q 1/32* (2006.01)
*H01Q 19/10* (2006.01)
(Continued)

(52) U.S. Cl.
CPC ..... *H01Q 19/10* (2013.01); *H01Q 1/3275* (2013.01); *H01Q 9/0407* (2013.01);
(Continued)

(58) Field of Classification Search
CPC ..... H01Q 1/3275; H01Q 1/325; H01Q 1/32; H01Q 21/0031; H01Q 21/031;
(Continued)

(56) References Cited

U.S. PATENT DOCUMENTS 5,977,914 A * 11/1999 Harano ..... H01Q 3/16 343/700 MS
10,074,895 B2 9/2018 Sugimoto et al.
(Continued)

FOREIGN PATENT DOCUMENTS

EP 0989629 A 3/2000
JP 6-97720 A 4/1994
(Continued)

OTHER PUBLICATIONS

International Search Report and Written Opinion dated Aug. 14, 2018 for PCT/JP2018/019197 filed on May 17, 2018, 16 pages including English Translation of the International Search Report.
(Continued)

*Primary Examiner* — Joseph J Lauture
(74) *Attorney, Agent, or Firm* — Xsensus LLP

(57) ABSTRACT

An antenna device for a vehicle includes: an antenna base to be attached to the vehicle; a first antenna for a first frequency band provided on the antenna base; and a second antenna for a second frequency band provided on the antenna base, in which the first frequency band and the second frequency band are different from each other, and the second antenna serves as a reflector of the first antenna in the first frequency band of the first antenna.

13 Claims, 17 Drawing Sheets

(51) Int. Cl.
*H01Q 9/04* (2006.01)
*H01Q 21/00* (2006.01)
*H01Q 21/06* (2006.01)

(52) U.S. Cl.
CPC ..... *H01Q 21/0025* (2013.01); *H01Q 21/062* (2013.01); *H01Q 1/32* (2013.01); *H01Q 1/325* (2013.01); *H01Q 21/0031* (2013.01); *H01Q 21/065* (2013.01)

(58) Field of Classification Search
CPC .... H01Q 21/065; H01Q 1/523; H01Q 9/0407; H01Q 1/22
See application file for complete search history.

(56) References Cited

U.S. PATENT DOCUMENTS

| | | | | |
|---|---|---|---|---|
| 2015/0091761 | A1* | 4/2015 | van Niekerk | H01Q 1/48 343/702 |
| 2015/0097738 | A1 | 4/2015 | Sugimoto et al. | |
| 2016/0064807 | A1 | 3/2016 | Reed et al. | |
| 2017/0149123 | A1* | 5/2017 | Kim | H01Q 1/1214 |
| 2019/0044549 | A1* | 2/2019 | Pillai | H04W 4/70 |

FOREIGN PATENT DOCUMENTS

| | | | |
|---|---|---|---|
| JP | H06-97720 | A | 4/1994 |
| JP | H09-232851 | A | 9/1997 |
| JP | 2004-328330 | A | 11/2004 |
| JP | 2005-175557 | A | 6/2005 |
| JP | 2007-142988 | A | 6/2007 |
| JP | 2009-290446 | A | 12/2009 |
| JP | 2011-216939 | A | 10/2011 |
| JP | 2012-54915 | A | 3/2012 |
| JP | 2012-054915 | A | 3/2012 |
| JP | 2013-051492 | A | 3/2013 |
| JP | 2015-084575 | A | 4/2015 |
| JP | 2015-159354 | A | 9/2015 |
| JP | 5874780 | B2 | 3/2016 |
| JP | 5918844 | B2 | 5/2016 |
| WO | 2016/175171 | A1 | 11/2016 |

OTHER PUBLICATIONS

European search report dated Jan. 21, 2021, in corresponding European patent Application No. 18803136.3, 13 pages.
Office Action dated Sep. 4, 2020, in corresponding Chinese patent Application No. 201880032098.5, 4 pages.
Extended European search report dated Sep. 6, 2021, in corresponding European patent Application No. 21173204.5, 7 pages.
Information Statement dated Sep. 21, 2021, in corresponding Japanese patent Application No. 2019-518881, 6 pages.

* cited by examiner

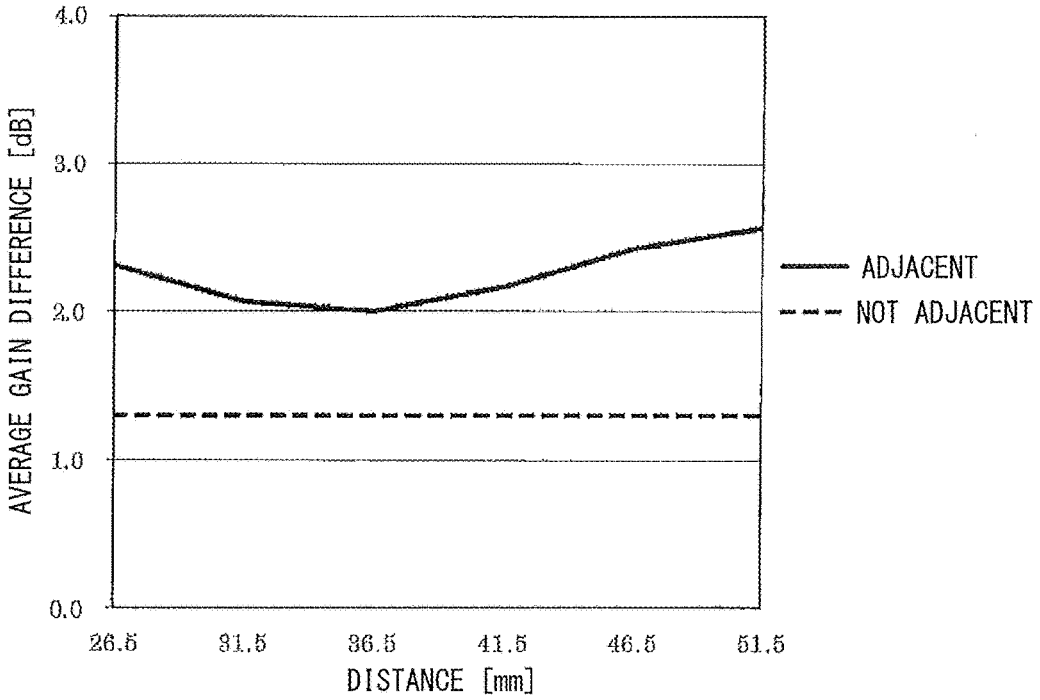
FIG. 7
FIG. 8
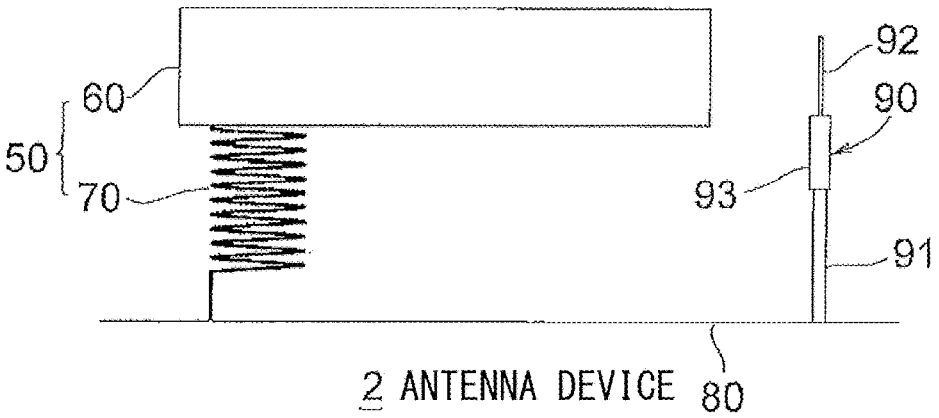
FIG. 9
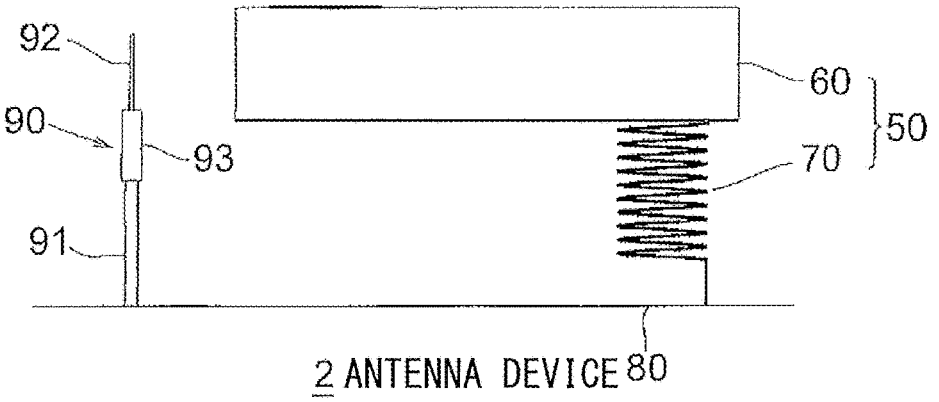

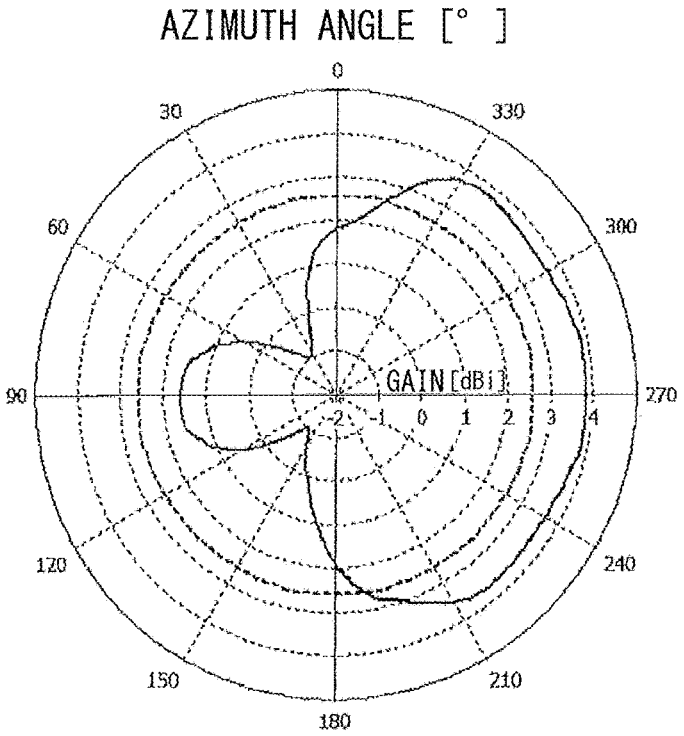
FIG. 10
FIG. 11
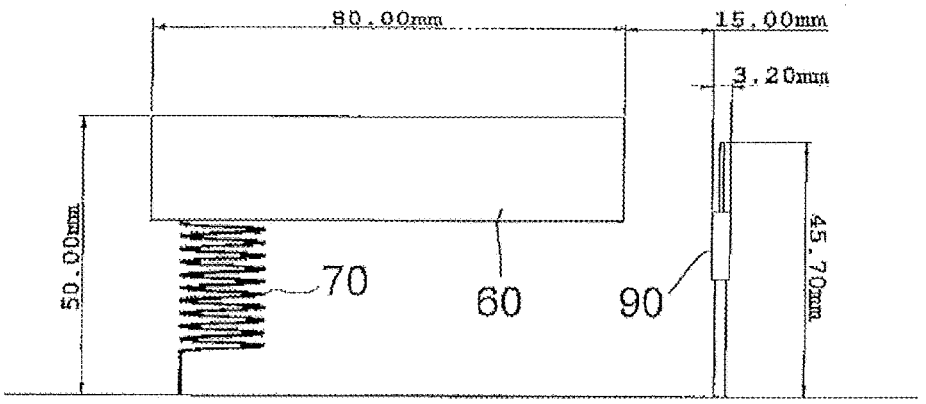
FIG. 12
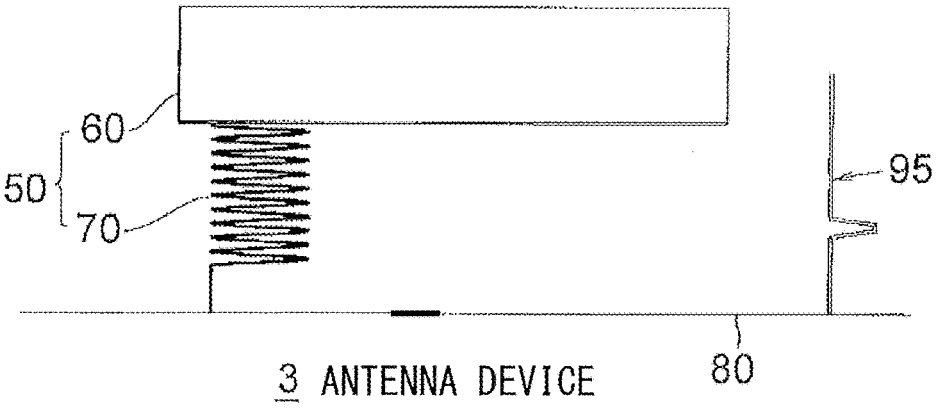

FIG. 13
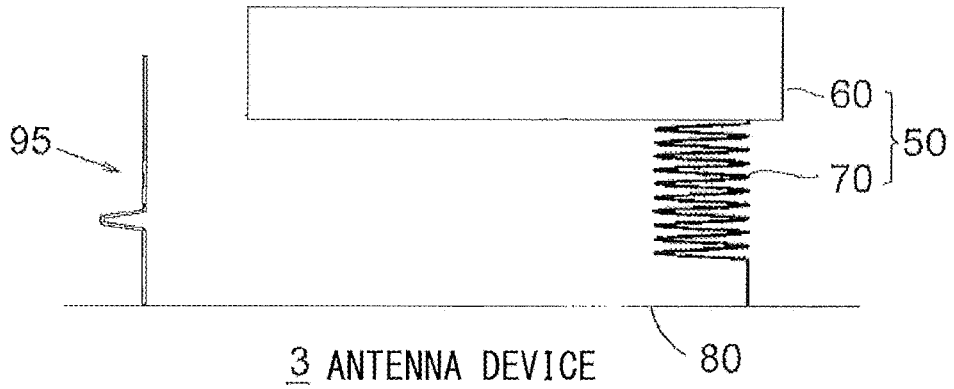
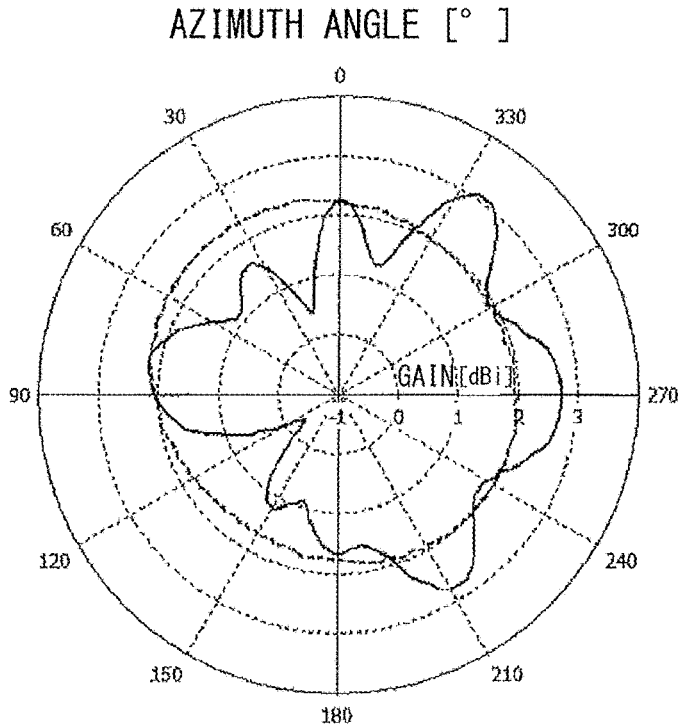
FIG. 14
FIG. 15
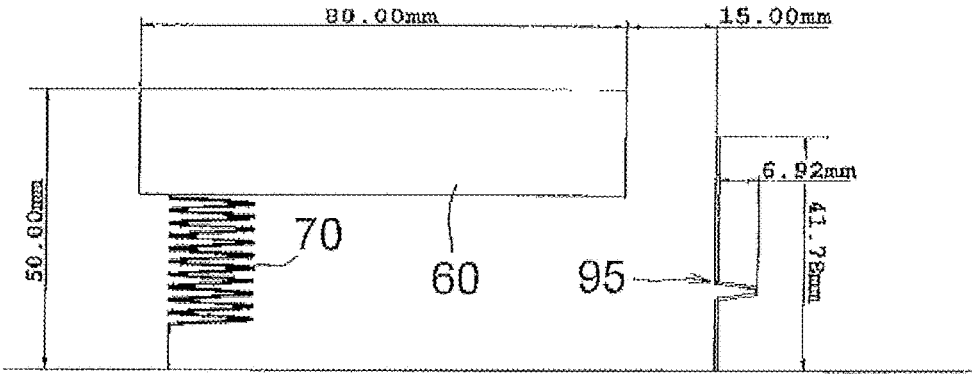

AVERAGE GAIN - 0.86 dBi

7 ANTENNA DEVICE

8 ANTENNA DEVICE

ANTENNA DEVICE FOR VEHICLE

CROSS-REFERENCE TO RELATED APPLICATIONS

The present application is a Bypass Continuation application of PCT/JP2018/019197, filed May 17, 2018, which claims priority to JP 2017-098433, filed May 17, 2017, the entire contents of each are incorporated herein by reference.

BACKGROUND OF THE INVENTION

Field of the Invention

The present invention relates to antenna devices which are installed in vehicles and used for V2X (Vehicle to X; Vehicle to Everything) communication or the like (vehicle-to-vehicle communication/road-to-vehicle communication, etc.) and more particularly relates to an antenna device for a vehicle that includes a plurality of kinds of antennas.

Description of the Related Art

Generally, as V2X antennas, for example, monopole antennas which are omnidirectional in the horizontal plane has been considered. FIG. 28 shows a directivity characteristic diagram in the horizontal plane with regard to simulation of vertical polarization at a frequency of 5887.5 MHz in the case in which a monopole antenna is vertically mounted on a circular ground plate (a conductive plate in a circular shape of 1 m in diameter). In the case of using the monopole antenna, the average gain is −0.86 dBi as indicated in FIG. 28 and the gain is low, and therefore, the monopole antenna in some cases does not satisfy specifications required for V2X communication when the monopole antenna is mounted on, for example, the roof of a vehicle body.

Furthermore, recently, an antenna device for a vehicle in which the average gain in one direction is higher than those in other directions is required in some cases. Moreover, for the purpose of accomplishing a plurality of kinds of communications, a plurality of antennas are accommodated together in an antenna case in many cases.

CITATION LIST

Patent Literature

Patent Literature 1: Japanese Patent No. 5874780

SUMMARY OF THE INVENTION

An antenna device for a vehicle according to the present disclosure includes an antenna base to be attached to the vehicle; and a first antenna and a second antenna, each operates in different frequency bands, on the antenna base, wherein the second antenna serves as a reflector of the first antenna in an operating frequency band of the first antenna.

BRIEF DESCRIPTION OF THE DRAWINGS

FIG. 7 shows a comparison diagram illustrating the difference in the average gain with regard to whether an adjacent antenna exists in the antenna device 1.

FIG. 8 shows a left side view of an antenna device 2 according to an embodiment 2 as viewed frontward.

FIG. 9 shows a right side view of the antenna device 2 as viewed frontward.

FIG. 10 shows a comparison diagram of directivity characteristic of the antenna device 2 with respect to vertical polarization in the horizontal plane.

FIG. 11 shows a side view illustrating an arrangement and a dimensional relationship of main constituent members of the antenna device 2.

FIG. 12 shows a left side view of an antenna device 3 according to an embodiment 3 as viewed frontward.

FIG. 13 shows a right side view of the antenna device 3 as viewed frontward.

FIG. 14 shows a comparison diagram of directivity characteristic of the antenna device 3 with respect to vertical polarization in the horizontal plane.

FIG. 15 shows a side view illustrating an arrangement and a dimensional relationship of main constituent members of the antenna device 3.

DESCRIPTION OF THE EMBODIMENTS

Figure 1:
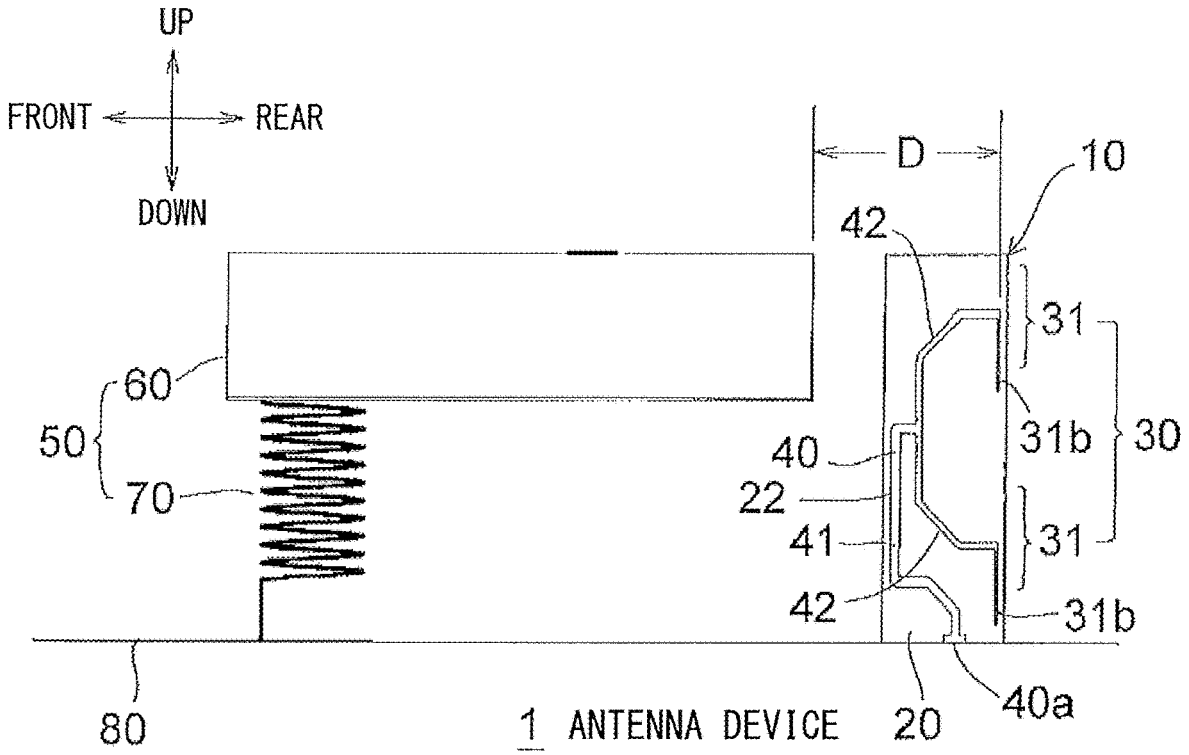
FIG. 1 shows a left side view of an antenna device 1 according to an embodiment 1 as viewed frontward.

Hereinafter, embodiments of the present invention are described with reference to the drawings. Constituent elements, members, or the like identical or equivalent to others shown in the respective drawings are assigned reference characters identical to those of the others and the redundant description thereof is omitted as appropriate. The embodiments do not limit the configuration and the like of the present invention and the embodiments are examples.

Embodiment 1

Figure 2:
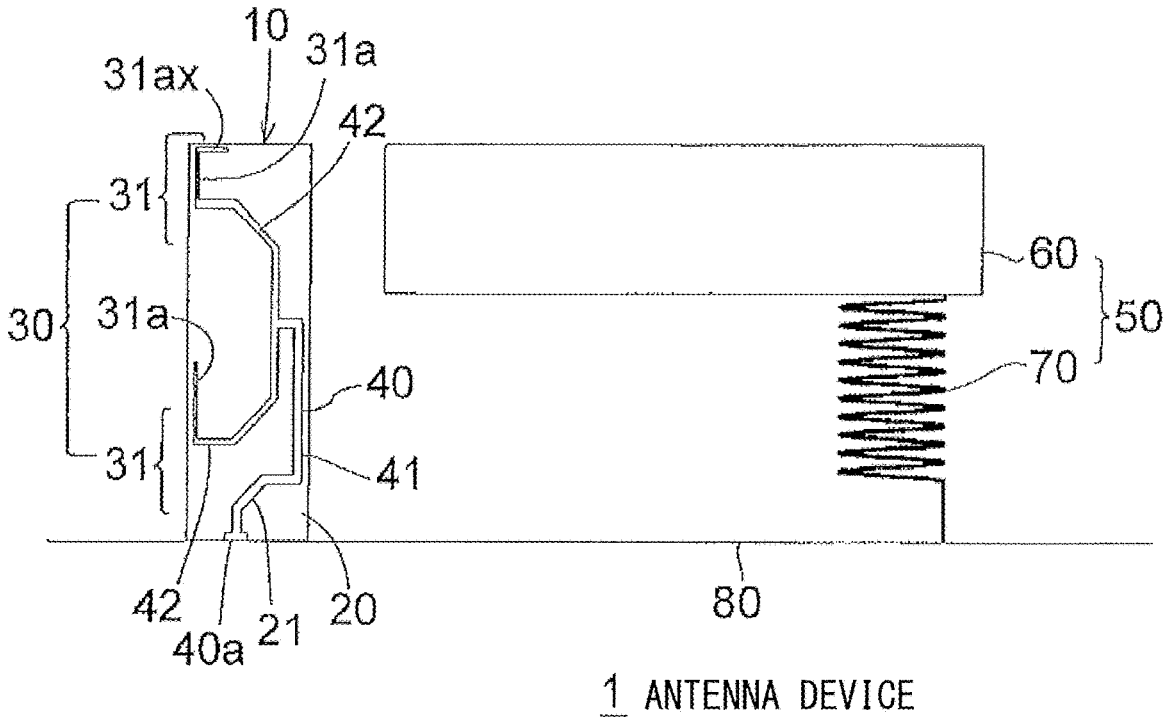
FIG. 2 shows a right side view of the antenna device 1 as viewed frontward.
Figure 3:
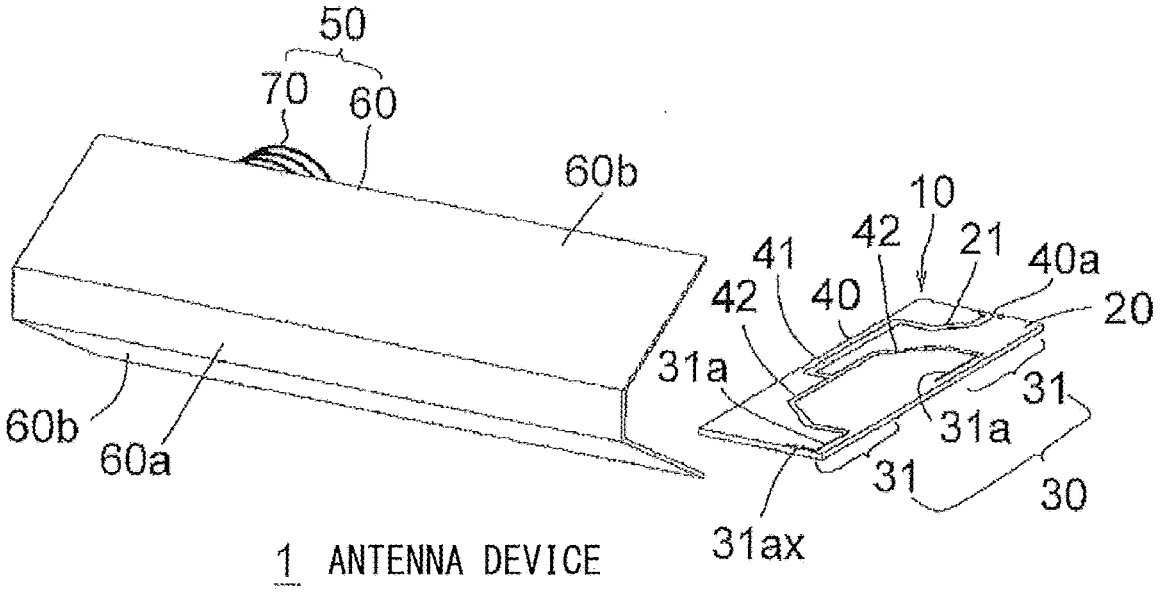
FIG. 3 shows a perspective view of a main part of the antenna device 1 when viewed from an upper rear right side.
Figure 4:
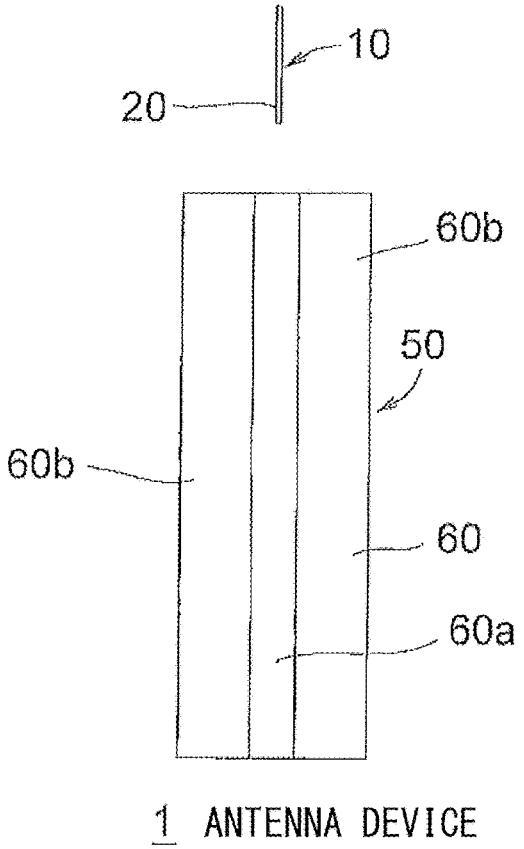
FIG. 4 shows a plan view of the antenna device 1 when viewed from an upper side.

FIG. 1 shows a left side view of an antenna device 1 according to an embodiment 1 of the present invention as viewed frontward. FIG. 2 shows a right side view thereof as also viewed frontward. FIG. 3 shows a perspective view of the antenna device 1 as viewed from an upper rear right side. FIG. 4 shows a plan view of the antenna device 1 as viewed from an upper side. In FIG. 1, the left direction of the sheet plane is regarded as the front direction of the antenna device 1, the right direction is regarded as the rear direction of the antenna device 1, the upward direction of the sheet plane is regarded as the upward direction of the antenna device 1, and the downward direction of the sheet plane is regarded as the downward direction of the antenna device 1.

As illustrated in FIGS. 1 to 4, the antenna device 1 according to the embodiment 1 includes an array antenna substrate 10, which is an example of a first antenna, and an AM/FM broadcast antenna element 50, which is an example of a second antenna. The array antenna substrate 10 and the AM/FM broadcast antenna element 50 are mounted on an antenna base 80 to be positioned adjacent (close) to each other. The array antenna substrate 10 includes two dipole antenna arrays 30 to which power can be simultaneously fed. The dipole antenna arrays 30 are each designed to have a size suitable for transmission or reception in an operating frequency band for V2X communication or the like, for example, at 5887.5 MHz. The AM/FM broadcast antenna element 50 includes a capacitance loading element 60 and a helical element 70. The capacitance loading element 60 is a component which is an example of a plate-like conductor having a face part facing the antenna base 80 and an edge facing the array antenna substrate 10. The capacitance loading element 60 can be made of a metal plate. The helical element 70 is a component which is an example of a linear conductive element and operates in the AM wave band (526 kHz to 1605 kHz) and the FM wave band (76 MHz to 90 MHz) in conjunction with the capacitance loading element 60. This means that the helical element 70 enables reception of signals in these frequency bands.

The array antenna substrate 10 includes a dielectric body substrate 20 which is formed of an insulating resin or the like and positioned in the upward direction on the antenna base 80. On the dielectric body substrate 20, a first face (a right side face as viewed frontward) and a second face (a left side face as viewed frontward) are formed. A first conductor pattern 21 of a copper foil or the like is formed on the first face and a second conductor pattern 22 of a copper foil or the like is formed on the second face.

The first conductor pattern 21 and the second conductor pattern 22 each operate as the dipole antenna array 30 for vertical polarization and the transmission line 40. The first conductor pattern 21 and the second conductor pattern 22 can be formed by, for example, etching on a substrate to which a copper foil adheres, or printing or plating with a conductor on the surface of a substrate.

The dipole antenna arrays 30 on both faces each have two dipole antennas 31 that are arrayed linearly in the up-down direction and that can be fed with power in phase. The array interval between the two dipole antennas 31 on both faces is an approximately ½ wave length of the operating frequency band of the dipole antennas 31. The dipole antennas 31 on the first face includes two elements 31*a*, lower ends of which are formed integrally with branch transmission lines 42. In contrast, the dipole antennas 31 on the second face includes two elements 31*b*, upper ends of which are formed integrally with branch transmission lines 42. This means that the elements 31*a* on the first face and the elements 31*b* on the second face are disposed not to overlap with each other on the dielectric body substrate 20.

Among the elements 31*a* on the first face, an end portion 31*ax* of the upper element is bent in the horizontal direction with respect to the antenna base 80. The upper element, nevertheless, has the same operating characteristics as those of the lower element 31*a*. By bending the end portion 31*ax* in the horizontal direction, the height of the array antenna substrate 10 is lowered.

No through hole is used in the structure of coupling the elements 31*a* and 31*b* of the dipole antenna arrays 30, the branch transmission lines 42, and the transmission lines 40.

The transmission lines 40 are formed as conductor patterns including two parallel lines such as parallel striplines. In the embodiment 1, the transmission lines 40 are constituted by shared transmission lines 41 that feed power to all the dipole antennas 31, the branch transmission lines 42 that are separated (T-branch) from the shared transmission lines 41 and that feed power individually to the dipole antennas 31, and feeding portions 40*a*.

The characteristic impedance of the transmission line 40 can be easily adjusted by changing the width of the conductor pattern and easily connected to components (an antenna element, a power feed coaxial line, and the like) having different impedances. In addition, the transmission line 40 serves as a divider and/or a phase shifter by appropriately changing the line length and/or the width of the transmission line.

The feeding portion 40*a* is positioned at the lower end of the dielectric body substrate 20. Power can be fed to the feeding portion 40*a* through, for example, a balanced line.

When the array antenna substrate 10 is caused to operate as, for example, a transmission antenna, radio frequency signals are supplied from the feeding portion 40*a*. The radio frequency signals are sent through the shared transmission line 41 and the branch transmission lines 42, reaches the dipole antennas 31 on both sides, and are consequently emitted in space. When the array antenna substrate 10 is caused to operate as a reception antenna, radio frequency signals are sent in a direction opposite to the direction used at the time of transmission.

Here, the AM/FM broadcast antenna element 50 positioned in front of the array antenna substrate 10 is described. As illustrated in FIGS. 3 and 4, the capacitance loading element 60 of the AM/FM broadcast antenna element 50 has a top portion 60*a* and slant faces 60*b* provided on both sides of the top portion 60*a*. One end of the helical element 70 is coupled to the top portion 60*a* so as to communicate with each other. The other end of the helical element 70 serves as a feeding point of the AM/FM broadcast antenna element 50, that is, an electrical connecting point of an AM/FM broadcast receiver.

A distance D between the dipole antenna arrays 30 on the array antenna substrate 10 and a rearmost end of the capacitance loading element 60 in the front-rear direction is equal to or longer than a ¼ wave length and equal to or shorter than an approximately 1 wave length of the operating frequency band of the dipole antenna arrays 30. In addition, as illustrated in FIG. 4, as viewed from an upper side, it is preferable that the array antenna substrate 10 be entirely positioned outside the capacitance loading element 60. The reasons for these will be described in detail later.

Figure 5:
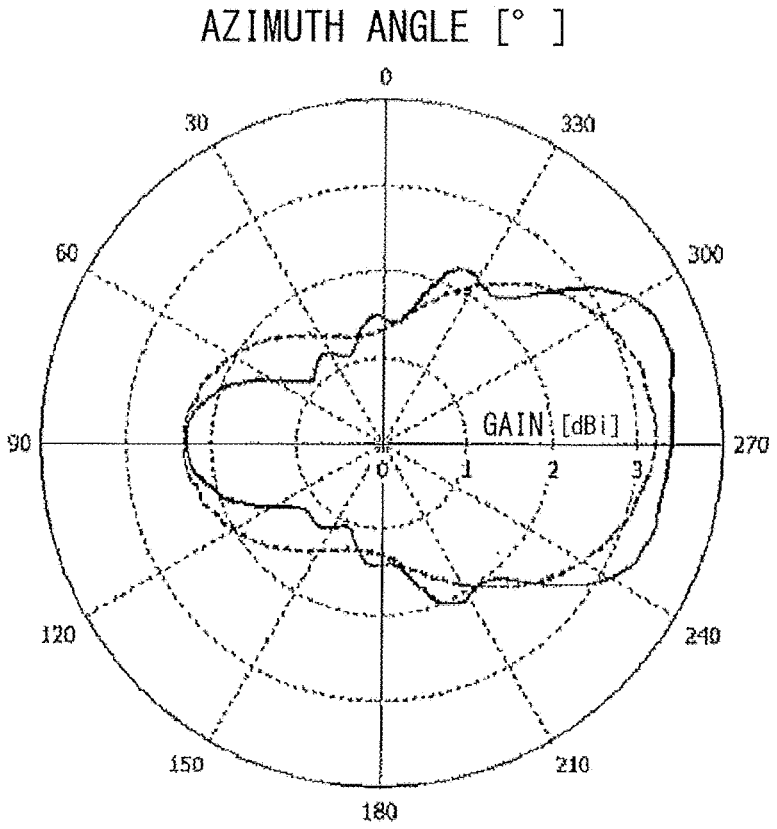
FIG. 5 shows a comparison diagram of directivity characteristic of the antenna device 1 with respect to vertical polarization in the horizontal plane.

FIG. 5 shows a comparison diagram of directivity characteristic of the antenna device 1 in the horizontal plane with respect to vertical polarization; in other words, FIG. 5 shows a characteristic diagram regarding simulation about the change in gain (dBi) of the array antenna substrate 10 in all directions in the horizontal plane with respect to vertical polarization, the simulation is conducted in the case in which the AM/FM broadcast antenna element 50 is provided adjacent to the array antenna substrate 10 in the front direction and in the case in which the AM/FM broadcast antenna element 50 is not present. A solid line indicates the former case and a dashed line indicates the latter case. The frequency is 5887.5 MHz, at which the dipole antenna arrays 30 operate. In the drawing, the azimuth angle 90° indicates the front direction and the azimuth angle 270° indicates the rear direction. The azimuth angles 0° to 180° correspond to the front half of the antenna device 1 and the azimuth angles 180° to 360° correspond to the rear half of the antenna device 1.

Each kind of directivity characteristic in FIG. 5 shows an example in the case in which a ground conductor (a conductive plate of 1 m in diameter) is provided instead of the antenna base 80 and provided at the position of the antenna base 80 of the antenna device 1.

Figure 6:
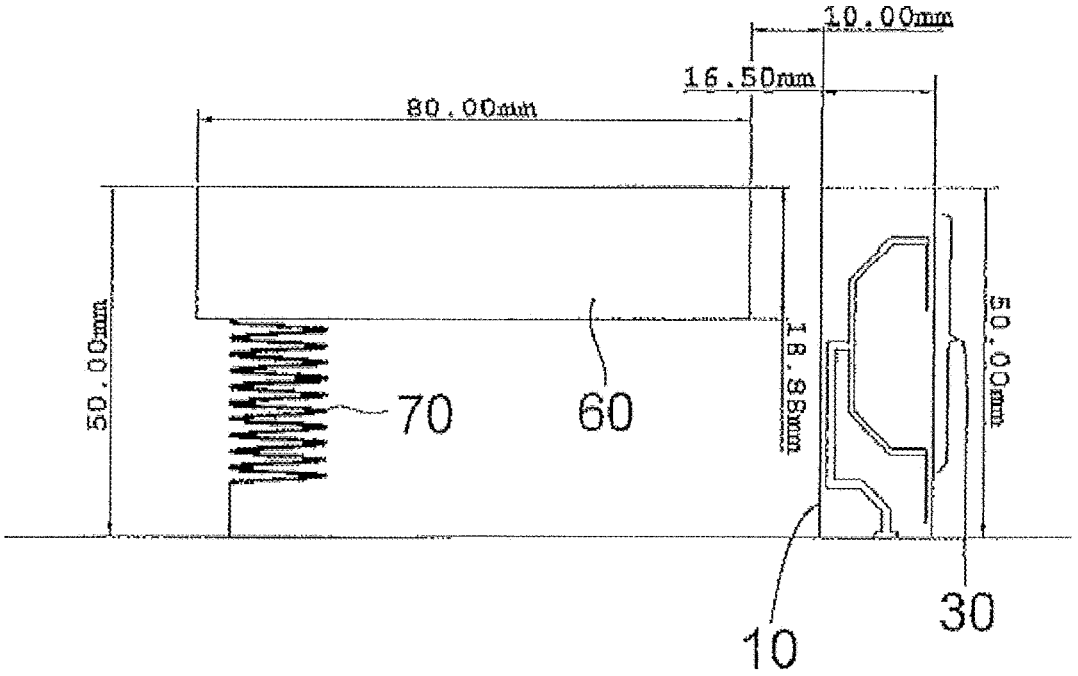
FIG. 6 shows a side view illustrating an arrangement and a dimensional relationship of main constituent members of the antenna device 1.

FIG. 6 shows a side view illustrating an arrangement and a dimensional relationship of main constituent members (the array antenna substrate 10, the dipole antenna arrays 30, the capacitance loading element 60, and the helical element 70) of the antenna device 1. As illustrated in FIG. 6, the distance (the closest distance) between the rearmost end of the capacitance loading element 60 and the rear edge of the array antenna substrate 10 in the front-rear direction is approximately 26.5 mm. The dipole antenna arrays 30 are provided close to the rear edge of the array antenna substrate 10. Accordingly, the distance D between the rearmost end of the capacitance loading element 60 and the dipole antenna arrays 30 in the front-rear direction is approximately 26.5 mm. These distances each correspond to an approximately ½ wave length of the operating frequency band of the dipole antenna arrays 30.

Referring to FIG. 5, when the AM/FM broadcast antenna element 50 is adjacent to the array antenna substrate 10 (the solid line), the average gain of the front half in the horizontal plane of the array antenna substrate 10 is 1.7 dBi. The average gain of the rear half is 4.0 dBi. The average gain of the rear half is higher than the average gain of the front half. The difference in the average gain between the front half and the rear half is 2.3 dBi. In comparison, when the AM/FM broadcast antenna element 50 is not adjacent to the array antenna substrate 10 (the dashed line), the average gain of the front half in the horizontal plane of the array antenna substrate 10 is 2.4 dBi, the average gain of the rear half is 3.7 dBi, and accordingly, the difference between the front half and the rear half is 1.3 dBi.

As described above, the difference in the average gain between the front half and the rear half in the horizontal plane of the array antenna substrate 10 in the case of the antenna device 1 is greater than the difference in the case in which the AM/FM broadcast antenna element 50 is not adjacent to the array antenna substrate 10 (the dashed line). This means that, concerning the antenna device 1, the average gain in the horizontal plane of the array antenna substrate 10 is higher than the average gain in the case in which the AM/FM broadcast antenna element 50 is not adjacent to the array antenna substrate 10. This is thought because the capacitance loading element 60 serves as a reflector of the array antenna substrate 10. Thus, the average gain of the rear half becomes much higher than the average gain of the front half with respect to the horizontal plane of the array antenna substrate 10.

FIG. 7 shows a comparison diagram illustrating the difference in the average gain with regard to whether or not an adjacent antenna exists in the antenna device 1; in other words, FIG. 7 shows a characteristic diagram illustrating the relationship between the distance D and the difference between the average gain of the front half and the average gain of the rear half in the horizontal plane of the array antenna substrate 10. As illustrated in FIG. 7, when the distance D is 51.5 mm (an approximately 1 wave length of the operating frequency band of the dipole antenna arrays 30), the average gain of the rear half in the horizontal plane of the array antenna substrate 10 is still greater than the average gain of the front half in comparison to the case in which the AM/FM broadcast antenna element 50 is not present.

As described above, it is understood that, when the distance D is within an approximately 1 wave length of the operating frequency band of the dipole antenna arrays 30, the capacitance loading element 60 of the AM/FM broadcast antenna element 50 serves as a reflector of the array antenna substrate 10 including the dipole antenna arrays 30.

The embodiment 1 has the effects described below.

(1) Since the array antenna substrate 10 includes the dipole antenna arrays 30, the average gain in the horizontal plane increases relative to a monopole antenna which is not an array. Furthermore, since the capacitance loading element 60 of the AM/FM broadcast antenna element 50 serves as a reflector of the array antenna substrate 10, the average gain of the rear half in the horizontal plane of the array antenna substrate 10 is higher than the average gain of the front half, and as a result, the directivity characteristic is imparted.

(2) Since the distance D between the rearmost end of the capacitance loading element 60 and the dipole antenna arrays 30 in the front-rear direction is within an approximately 1 wave length of the operating frequency band of the dipole antenna arrays 30, it is possible to downsize the external shape of a case accommodating the array antenna substrate 10 and the AM/FM broadcast antenna element 50.

(3) Since the array antenna substrate 10 is composed of the dipole antenna array 30 and the transmission line 40 that are made as conductor patterns on each side of the dielectric body substrate 20, materials and manufacturing costs can be reduced in comparison to the case of using, for example, a coaxial structure or a sleeve structure. Moreover, since no through hole is provided for the dipole antenna arrays 30 and the transmission lines 40 in the structure, the cost can be further eliminated.

Embodiment 2

FIG. 8 shows a left side view of an antenna device 2 according to an embodiment 2 as viewed frontward and FIG. 9 shows a right side view thereof as viewed frontward. The front-rear direction and the up-down direction in FIG. 8 are the same as those in FIG. 1. The antenna device 2 differs from the antenna device 1 in that a sleeve antenna 90 is used as the first antenna. The sleeve antenna 90 is formed such that a center conductor 92 is extended upwardly from the upper end of a coaxial line 91 (including an outer conductor 93) by a ¼ wave length of an operating frequency band (for example, a resonant frequency band) of the sleeve antenna 90. The outer conductor 93 is folded downwardly to cover outside of an outer circumferential insulator of the coaxial line 91 by a ¼ wave length of the operating frequency band of the sleeve antenna 90. The structures excluding the sleeve antenna 90 are the same as those of the embodiment 1.

FIG. 10 shows a comparison diagram of directivity characteristic of the antenna device 2 with respect to vertical polarization in the horizontal plane; in other words, FIG. 10 shows a characteristic diagram regarding simulation about the change in gain (dBi) of the sleeve antenna 90 in all directions in the horizontal plane with respect to vertical polarization, the simulation is conducted in the case in which the AM/FM broadcast antenna element 50 is provided adjacent to the sleeve antenna 90 in the front direction and in the case in which the AM/FM broadcast antenna element 50 is not present. A solid line indicates the former case and a dashed line indicates the latter case. The frequency is 5887.5 MHz, at which the sleeve antenna 90 operates. In FIG. 10, the azimuth angle 90° indicates the front direction and the azimuth angle 270° indicates the rear direction. The azimuth angles 0° to 180° correspond to the front half of the antenna device 2 and the azimuth angles 180° to 360° correspond to the rear half of the antenna device 2.

Each kind of directivity characteristic in FIG. 10 shows an example in the case in which a ground conductor (a conductive plate of 1 m in diameter) is provided instead of the antenna base 80 and provided at the position of the antenna base 80 of the antenna device 2.

FIG. 11 shows a side view illustrating an arrangement and a dimensional relationship of main constituent members (the sleeve antenna 90, the capacitance loading element 60, and the helical element 70) when the directivity characteristic diagram in FIG. 10 is obtained. As illustrated in FIG. 11, the distance between the rearmost end of the capacitance loading element 60 and the outer circumference of the sleeve antenna 90 in the front-rear direction is 15.0 mm.

In the case of the antenna device 2 (the solid line), the average gain of the front half in the horizontal plane of the sleeve antenna 90 is 0.5 dBi, the average gain of the rear half is 3.4 dBi, and accordingly, the difference between the front half and the rear half is 2.9 dBi. In comparison, when the AM/FM broadcast antenna element 50 is not adjacent to the sleeve antenna 90 (the dashed line), the average gain of the front half in the horizontal plane of the sleeve antenna 90 is 2.6 dBi, the average gain of the rear half is 2.6 dBi, and accordingly, there is no difference between the front half and the rear half.

Figure 28:
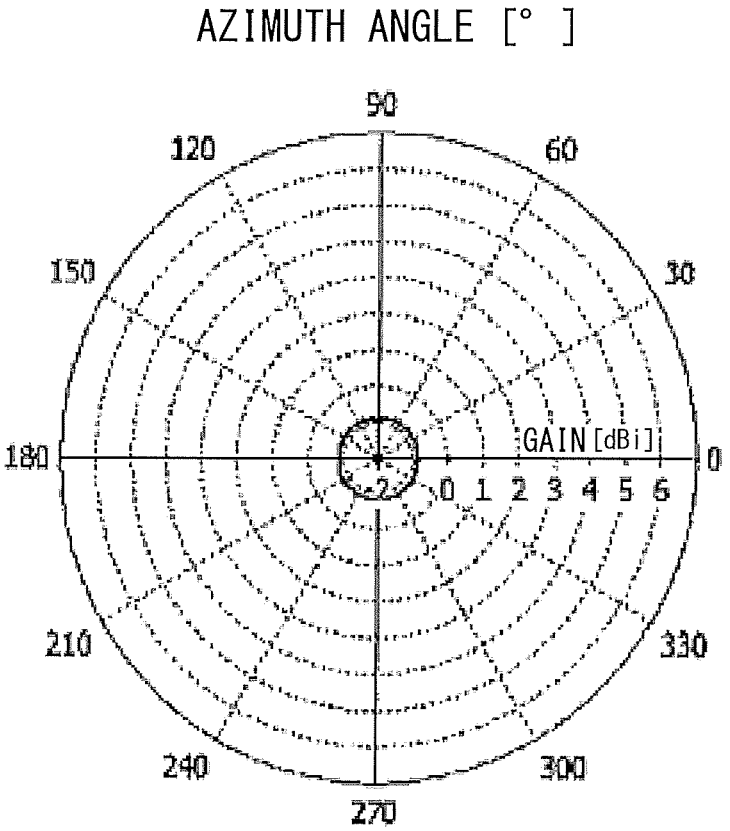
FIG. 28 shows a directivity characteristic diagram of a general monopole antenna in the horizontal plane.

As described above, concerning the antenna device 2, the average gain in the horizontal plane of the sleeve antenna 90 is higher than the average gain in the horizontal plane of the monopole antenna illustrated in FIG. 28. As described above, the difference in the average gain between the front half and the rear half in the horizontal plane of the sleeve antenna 90 is relatively great in contrast to the case in which the AM/FM broadcast antenna element 50 is not present.

Furthermore, since the sleeve antenna 90 has gain higher than that of the monopole antenna and the adjacent capacitance loading element 60 serves as a reflector, the average gain of the rear half in the horizontal plane of the sleeve antenna 90 is higher than the average gain of the front half.

As illustrated in FIG. 11, the distance between the rearmost end of the capacitance loading element 60 and the outer circumference of the sleeve antenna 90 in the front-rear direction is 15.0 mm, which is shorter than a ½ wave length of the operating frequency band of the sleeve antenna 90. When the distance in the front-rear direction is within an approximately 1 wave length of the operating frequency band of the sleeve antenna 90, the capacitance loading element 60 serves as a reflector of the sleeve antenna 90, and as a result, the average gain of the rear half in the horizontal plane of the sleeve antenna 90 is higher than the average gain of the front half.

Embodiment 3

FIG. 12 shows a left side view of an antenna device 3 according to an embodiment 3 as viewed frontward and FIG. 13 shows a right side view thereof as viewed frontward. The front-rear direction and the up-down direction in FIG. 12 are the same as those in FIG. 1. The antenna device 3 differs from the antenna devices 1 and 2 in that a collinear array antenna 95 is used as the first antenna for vertical polarization. The collinear array antenna 95 is formed, for example, such that multiple elements that are each ½ wave length long with respect to an operating frequency band and configured to be in phase are connected in series with the upper end of an element of a monopole antenna which is vertically positioned and is ¼ wave length long with respect to an operating frequency band.

FIG. 14 shows a comparison diagram of directivity characteristic of the antenna device 3 in the horizontal plane with respect to vertical polarization; in other words, FIG. 14 shows a characteristic diagram regarding simulation about the change in gain (dBi) of the collinear array antenna 95 in all directions in the horizontal plane with respect to vertical polarization, the simulation is conducted in the case in which the capacitance loading element 60 of the AM/FM broadcast antenna element 50 is provided adjacent to the collinear array antenna 95 in the front direction and in the case in which the capacitance loading element 60 of the AM/FM broadcast antenna element 50 is not present. A solid line indicates the former case and a dashed line indicates the latter case. The frequency is 5887.5 MHz, at which the collinear array antenna 95 operates. In FIG. 14, the azimuth angle 90° indicates the front direction and the azimuth angle 270° indicates the rear direction. The azimuth angles 0° to 180° correspond to the front half of the antenna device 3 and the azimuth angles 180° to 360° correspond to the rear half of the antenna device 3.

Each kind of directivity characteristic in FIG. 14 shows an example in the case in which a ground conductor (a conductive plate of 1 m in diameter) is provided instead of the antenna base 80 and provided at the position of the antenna base 80 of the antenna device 3.

FIG. 15 shows a side view illustrating an arrangement and a dimensional relationship of main constituent members (the collinear array antenna 95, the capacitance loading element 60, and the helical element 70) of the antenna device 3. As illustrated in FIG. 15, the distance between the rearmost end of the capacitance loading element 60 and the collinear array antenna 95 in the front-rear direction is 15.0 mm.

In the case of the antenna device 3 (the solid line), the average gain of the front half in the horizontal plane of the collinear array antenna 95 is 1.2 dBi, the average gain of the rear half is 2.2 dBi, and accordingly, the difference between the front half and the rear half is 1.0 dBi. In comparison, when the capacitance loading element 60 is not adjacent to the collinear array antenna 95 (the dashed line), the average gain of the front half in the horizontal plane of the collinear array antenna 95 is 2.0 dBi, the average gain of the rear half is 2.0 dBi, and accordingly, there is no difference between the front half and the rear half.

As described above, in the case of the antenna device 3, the average gain in the horizontal plane of the collinear array antenna 95 is higher than the average gain in the horizontal plane of the monopole antenna illustrated in FIG. 28.

As described above, the difference in the average gain between the front half and the rear half in the horizontal plane of the collinear array antenna 95 is relatively great in contrast to the case in which the capacitance loading element 60 is not adjacent to the collinear array antenna 95.

Moreover, concerning the antenna device 3, the average gain in the horizontal plane is higher than the average gain of the monopole antenna and the average gain of the rear half in the horizontal plane of the collinear array antenna 95 is higher than the average gain of the front half in contrast to the case in which the capacitance loading element 60 is not present.

As illustrated in FIG. 15, the distance between the rearmost end of the capacitance loading element 60 and the outer circumference of the collinear array antenna 95 in the front-rear direction is 15.0 mm, which is shorter than a ½ wave length of an operating frequency band of the collinear array antenna 95. When the distance in the front-rear direction is within an approximately 1 wave length of the operating frequency band of the collinear array antenna 95, the capacitance loading element 60 serves as a reflector, and as a result, the average gain of the rear half in the horizontal plane of the collinear array antenna 95 is higher than the average gain of the front half.

Embodiment 4

Figure 16:
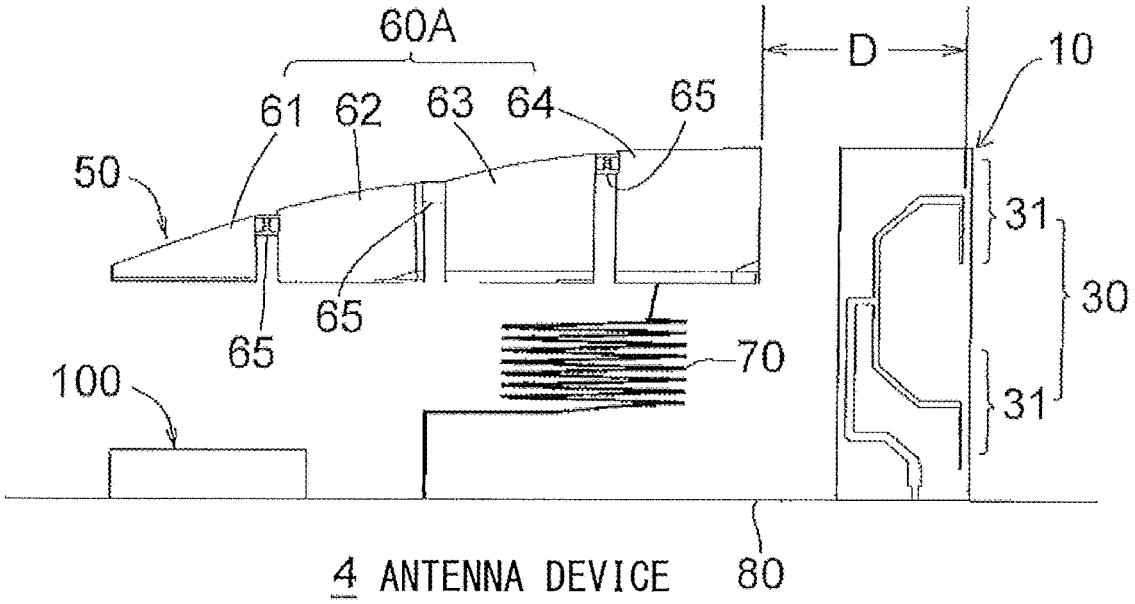
FIG. 16 shows a left side view of an antenna device 4 according to an embodiment 4 as viewed frontward.
Figure 17:
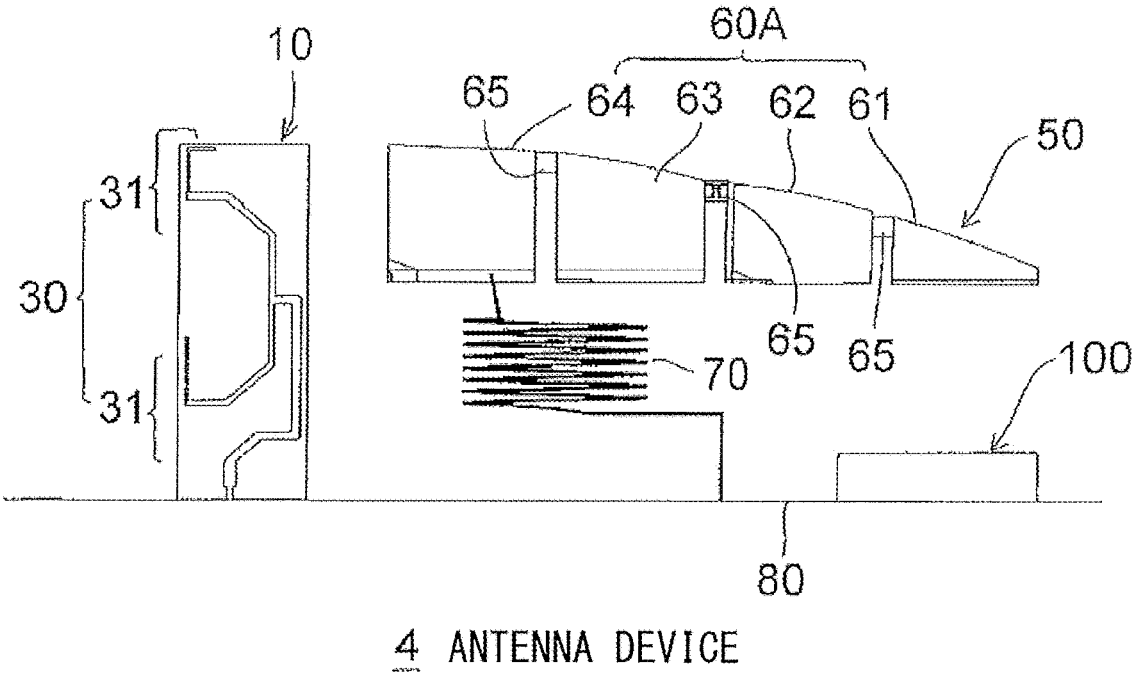
FIG. 17 shows a right side view of the antenna device 4 as viewed frontward.
Figure 18:
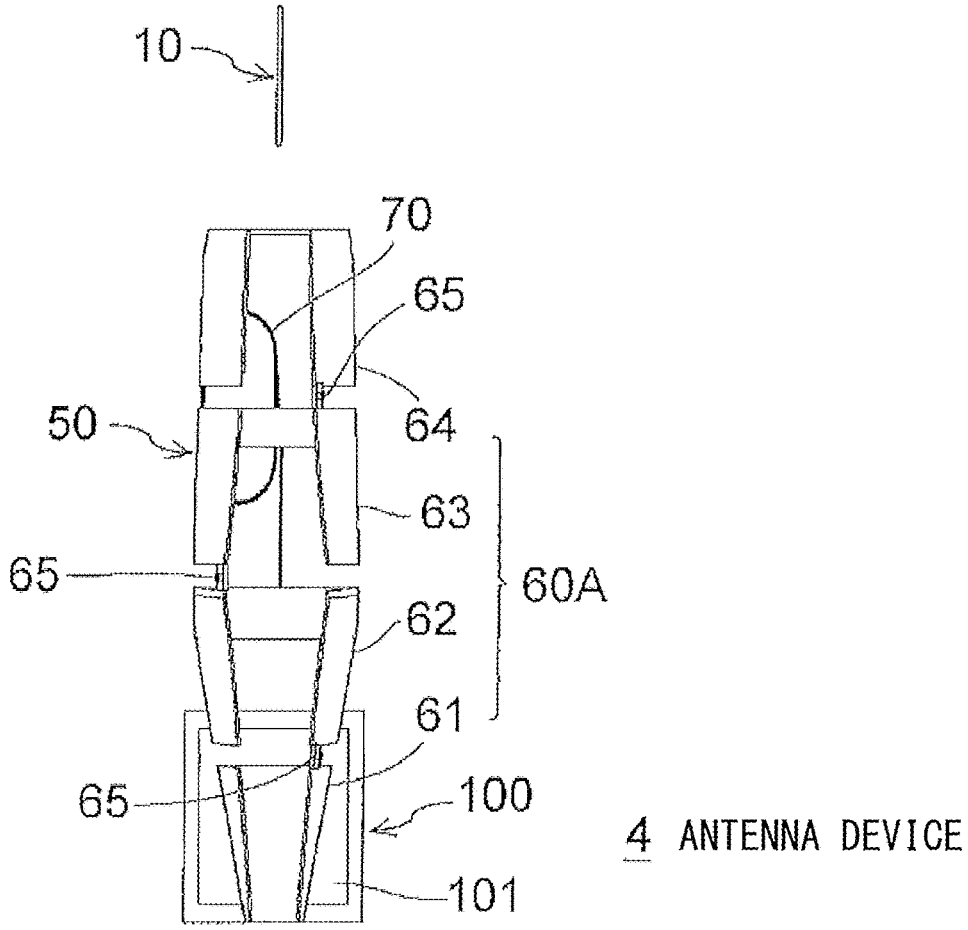
FIG. 18 shows a plan view of the antenna device 4 as viewed from an upper side.
Figure 19:
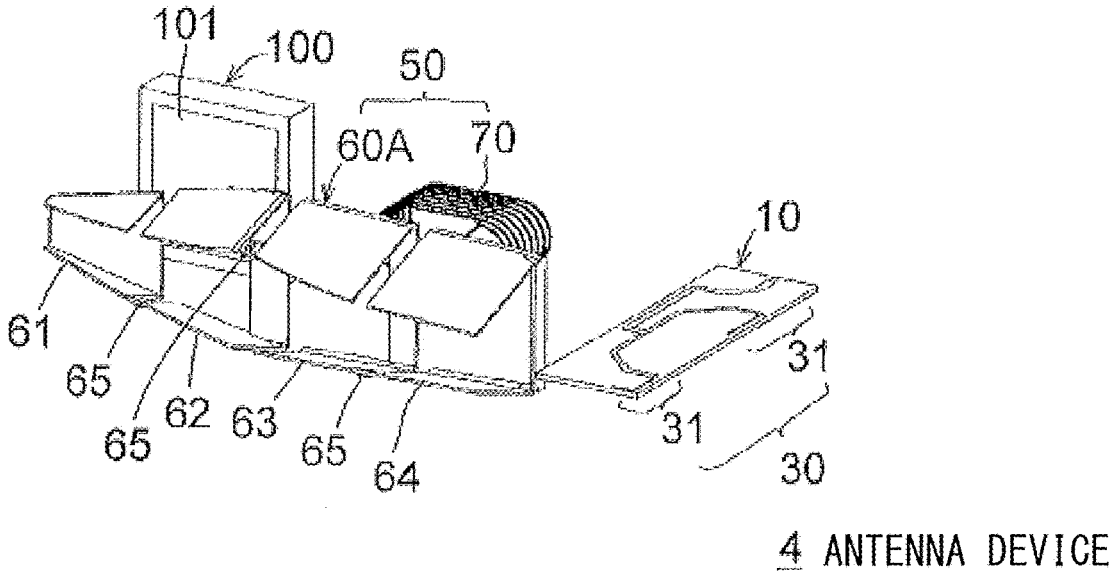
FIG. 19 shows a perspective view of the antenna device 4 as viewed from an upper rear right side.

FIG. 16 shows a left side view of an antenna device 4 according to an embodiment 4 as viewed frontward and FIG. 17 shows a right side view thereof as viewed frontward. FIG. 18 shows a plan view thereof as viewed from an upper side, and FIG. 19 shows a perspective view thereof as viewed from an upper rear right side. The front-rear direction and the up-down direction in FIG. 16 are the same as those in FIG. 1. The antenna device 4 differs from the antenna device 1 in the structure of the AM/FM broadcast antenna element 50 and that a patch antenna 100 is included. In the AM/FM broadcast antenna element 50 of the antenna device 4, a capacitance loading element 60A does not have a top portion and is formed by separated bodies. Each of the separated bodies has a distal edge, the distal edges being opposed to each other in the transverse direction are connected to each other. The separated bodies are arranged in the front-rear direction. The patch antenna 100 is positioned below the capacitance loading element 60A. The capacitance loading element 60A has a structure that the separated bodies 61, 62, 63, and 64 are each coupled to adjacent ones by filters 65. Each of separated bodies 61, 62, 63, and 64 is composed of a conductive plate which has a shape formed by chevron-shaped slant faces being connected to each other by a bottom portion. The filter 65 has low impedance in the AM/FM broadcast frequency bands and high impedance in the operating frequency band of the array antenna substrate 10 and the operating frequency band of the patch antenna 100. Thus, in the AM/FM broadcast frequency bands, the one formed by connecting the separated bodies 61, 62, 63, and 64 to each other can be deemed as one large conductor. As illustrated in FIGS. 18 and 19, the patch antenna 100 includes a radiation electrode 101 on the top face thereof and has the upward directivity characteristic.

Figure 20:
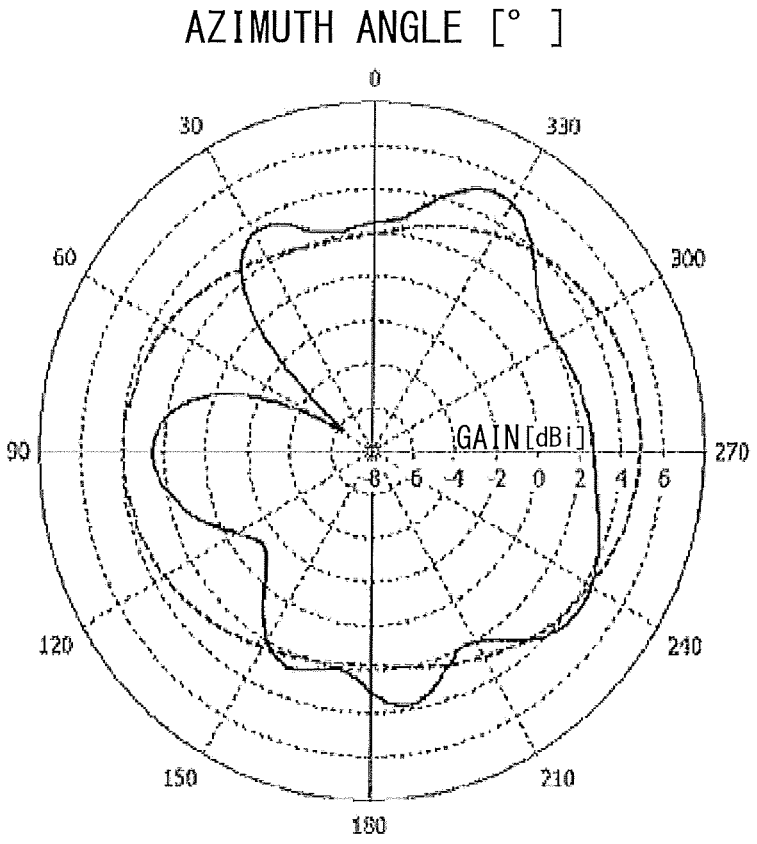
FIG. 20 shows a comparison diagram of directivity characteristic of the antenna device 4 with respect to vertical polarization in the horizontal plane.

FIG. 20 shows a comparison diagram of directivity characteristic of the antenna device 4 in the horizontal plane with respect to vertical polarization; in other words, FIG. 20 shows a characteristic diagram regarding simulation about the change in gain (dBi) of the array antenna substrate 10 in all directions in the horizontal plane with respect to vertical polarization, the simulation is conducted in the case in which the AM/FM broadcast antenna element 50 including the capacitance loading element 60A of the divided structure is provided adjacent to the array antenna substrate 10 in the front direction and in the case in which the AM/FM broadcast antenna element 50 including the capacitance loading element 60A of the divided structure is not provided adjacent to the array antenna substrate 10. A solid line indicates the former case and a dashed line indicates the latter case. The frequency is 5887.5 MHz, at which the dipole antenna arrays 30 of the array antenna substrate 10 operate. In FIG. 20, the azimuth angle 90° indicates the front direction and the azimuth angle 270° indicates the rear direction. The azimuth angles 0° to 180° correspond to the front half of the antenna device 4 and the azimuth angles 180° to 360° correspond to the rear half of the antenna device 4. Each kind of directivity characteristic in FIG. 20 is an example in the case in which a ground conductor (a conductive plate of 1 m in diameter) is provided instead of the antenna base 80 and provided at the position of the antenna base 80 of the antenna device 4.

Figure 21:
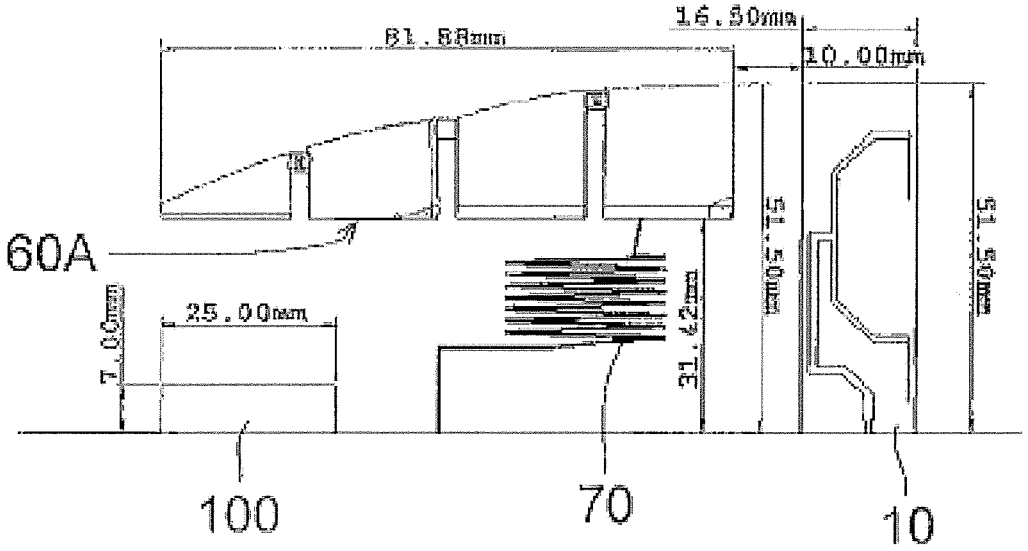
FIG. 21 shows a side view illustrating an arrangement and a dimensional relationship of main constituent members of the antenna device 4.

FIG. 21 shows a side view illustrating an arrangement and a dimensional relationship of main constituent members (the array antenna substrate 10, the capacitance loading element 60A, the helical element 70, and the patch antenna 100) of the antenna device 4. As illustrated in FIG. 21, the distance between the rearmost end of the capacitance loading element 60A and the rear edge of the array antenna substrate 10 in the front-rear direction is 26.5 mm. Since the dipole antenna arrays 30 are positioned close to the rear edge of the array antenna substrate 10, the distance D between the rearmost end of the capacitance loading element 60A and the dipole antenna arrays 30 in the front-rear direction is approximately 26.5 mm. These distances each correspond to an approximately ½ wave length of the operating frequency band of the dipole antenna arrays 30.

The directivity characteristic in FIG. 20 shows in the case in which the distance D between the rearmost end of the capacitance loading element 60A and the dipole antenna arrays 30 in the front-rear direction is an approximately ½ wave length of the operating frequency band of the dipole antenna arrays 30 as illustrated in FIG. 21. When the distance D is within an approximately 1 wave length of the operating frequency band of the dipole antenna arrays 30, the capacitance loading element 60A serves as a reflector in contrast to the case in which the AM/FM broadcast antenna element 50 is not present. Thus, the average gain of the rear half becomes higher than the average gain of the front half with respect to the horizontal plane of the array antenna substrate 10.

Referring to FIG. 20, in the case of the antenna device 4 (the solid line), the average gain of the front half in the horizontal plane of the array antenna substrate 10 is 1.3 dBi, the average gain of the rear half is 3.3 dBi, and accordingly, the difference between the front half and the rear half is 2.0 dBi. In comparison, when the AM/FM broadcast antenna element 50 is not adjacent to the array antenna substrate 10 (the dashed line), the average gain of the front half in the horizontal plane of the array antenna substrate 10 is 2.8 dBi, the average gain of the rear half is 3.7 dBi, and accordingly, the difference between the front half and the rear half is 0.9 dBi.

As described above, in the case of the antenna device 4, the difference in the average gain between the front half and the rear half in the horizontal plane of the array antenna substrate 10 in the case of the antenna device 4 is relatively great in contrast to the case in which the AM/FM broadcast antenna element 50 is not adjacent to the array antenna substrate 10. In the case of the antenna device 4, the average gain in the horizontal plane is higher than the average gain in the case of the monopole antenna; in contrast to the case in which the AM/FM broadcast antenna element 50 is not adjacent to the array antenna substrate 10, since the capacitance loading element 60A operates as a reflector, the average gain of the rear half in the horizontal plane of the array antenna substrate 10 is still higher than the average gain of the front half.

Figure 22:
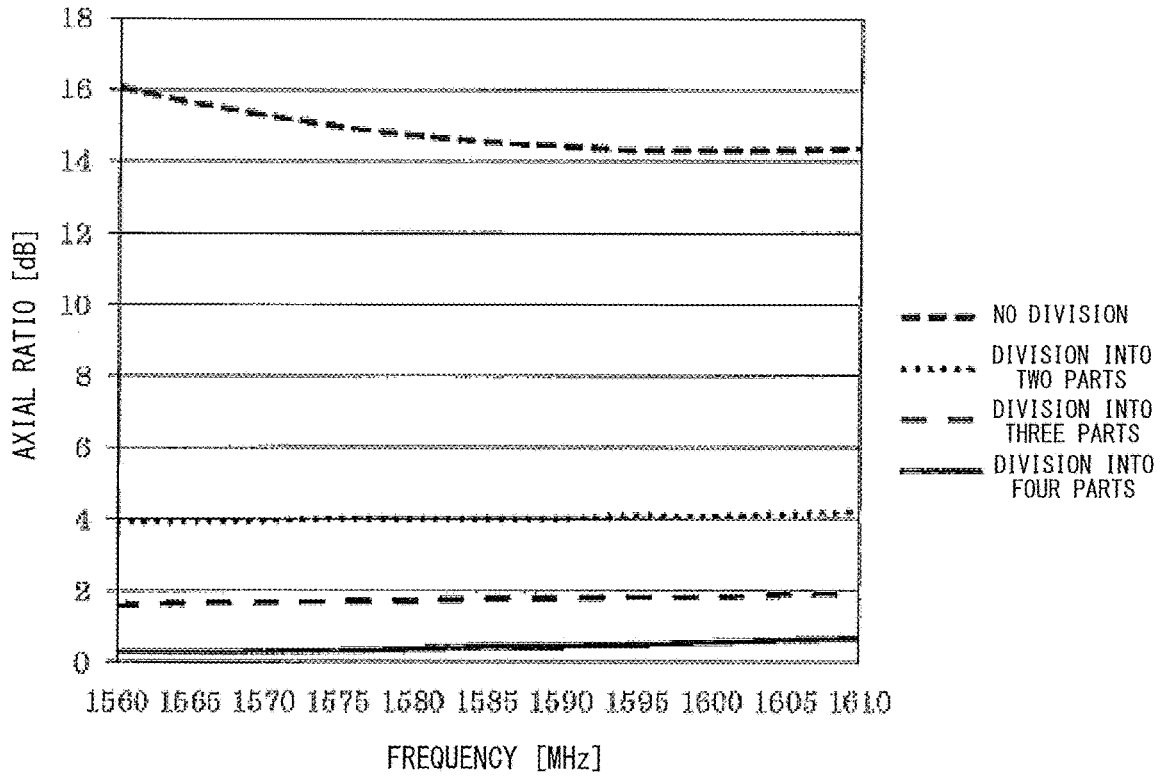
FIG. 22 shows a characteristic diagram illustrating a relationship between the frequency of a patch antenna and the axial ratio with respect to whether a capacitance loading element is divided in the front-rear direction in the antenna device 4.
Figure 23:
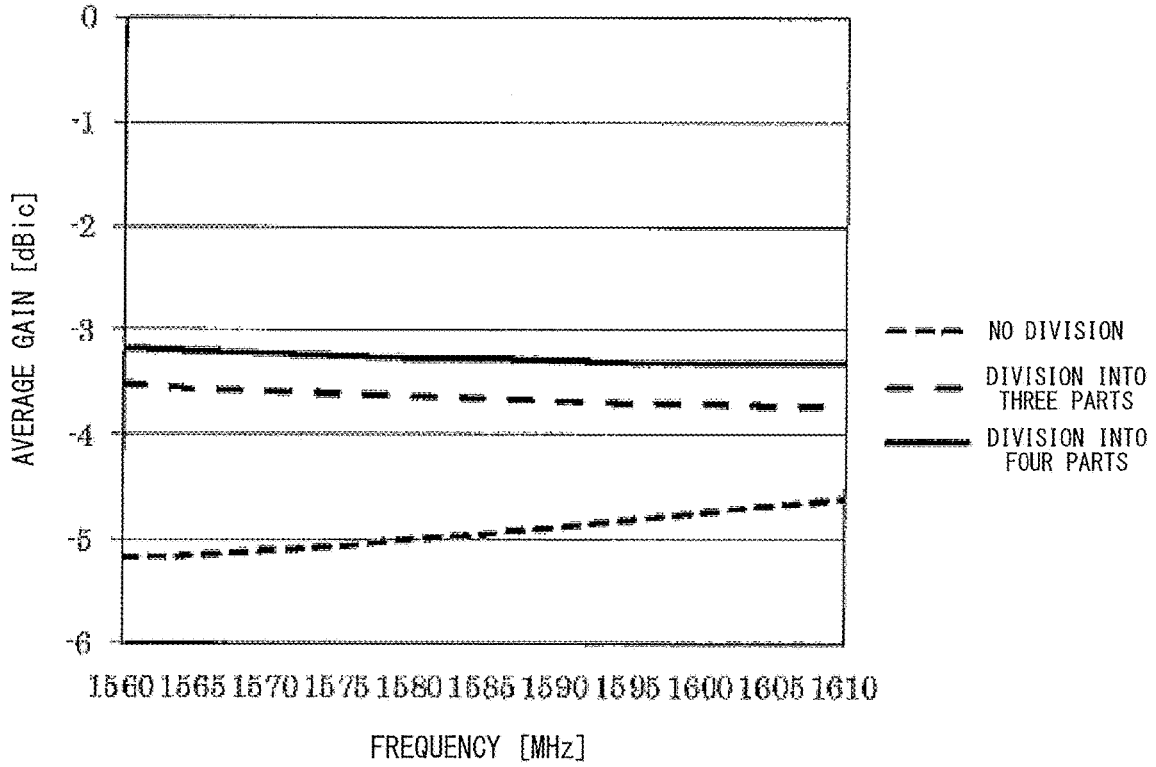
FIG. 23 shows a characteristic diagram illustrating a relationship between the frequency and the average gain of circularly polarized waves when the elevation angle of the patch antenna is 10° with respect to whether the capacitance loading element is divided in the front-rear direction in the antenna device 4.

FIG. 22 shows a characteristic diagram illustrating a relationship between the frequency of the patch antenna and the axial ratio (dB) with respect to whether or not the capacitance loading element 60A is divided in the front-rear direction in the antenna device 4. FIG. 23 shows a characteristic diagram illustrating a relationship between the frequency and the average gain of circularly polarized waves when the elevation angle of the patch antenna is 10° with respect to whether or not the capacitance loading element is divided in the front-rear direction in the antenna device 4. In FIGS. 22 and 23, "No Division" corresponds to the capacitance loading element 60 of the embodiment 1. "Division into Four Parts" corresponds to the capacitance loading element 60A of the present embodiment. "Division into Two Parts" and "Division into Three Parts" correspond respectively to the case in which the capacitance loading element is divided into two in the front-rear direction and the case in which the capacitance loading element is divided into three in the front-rear direction.

As apparent from FIG. 22, as the number of divisions of the capacitance loading element increases, the axial ratio (dB) decreases, and thus, the directivity characteristic of the patch antenna 100 is improved. Furthermore, when the size of each of the separated bodies 61 to 64 of the capacitance loading element 60A in the front-rear direction is relatively small with respect to the wave length of the operating frequency band of the patch antenna 100 (this means that the number of divisions increases), adverse effects (decrease in the average gain and the like) on the patch antenna 100 due to the separated bodies 61 to 64 of the capacitance loading element 60A can be mitigated. As a result, as illustrated in FIG. 23, in contrast to the case in which the capacitance loading element is not divided, the average gain at a small elevation angle (the 10° elevation angle) is improved.

As described above, when the capacity loading element is divided and arranged in the front-rear direction, the axial ratio of circularly polarized waves decreases, and thus, transmission and/or reception of circularly polarized waves performed by the patch antenna 100 is improved.

Embodiment 5

Figure 24:
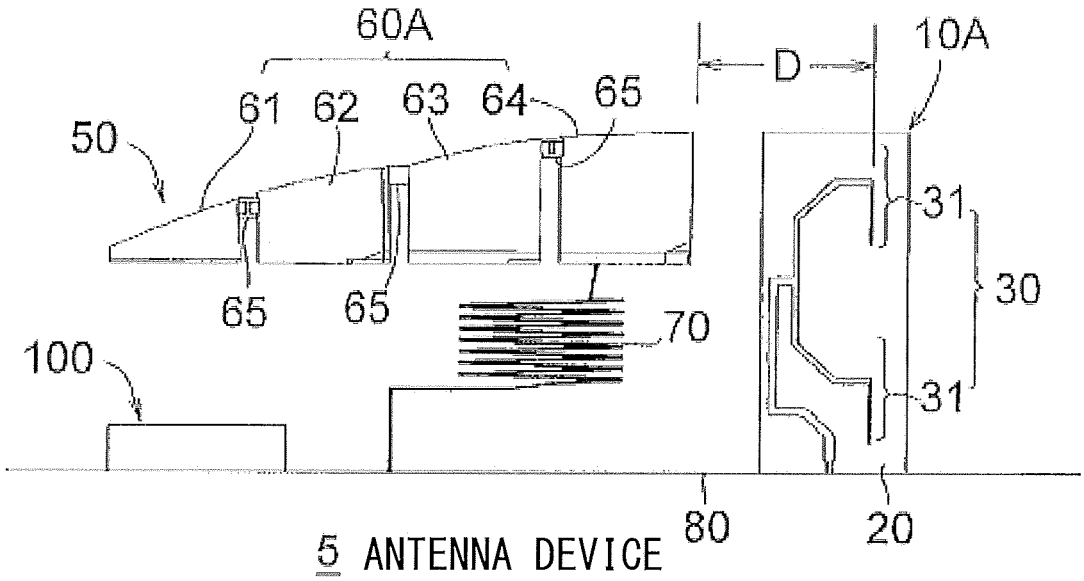
FIG. 24 shows a left side view of an antenna device 5 according to an embodiment 5 as viewed frontward.
Figure 25:
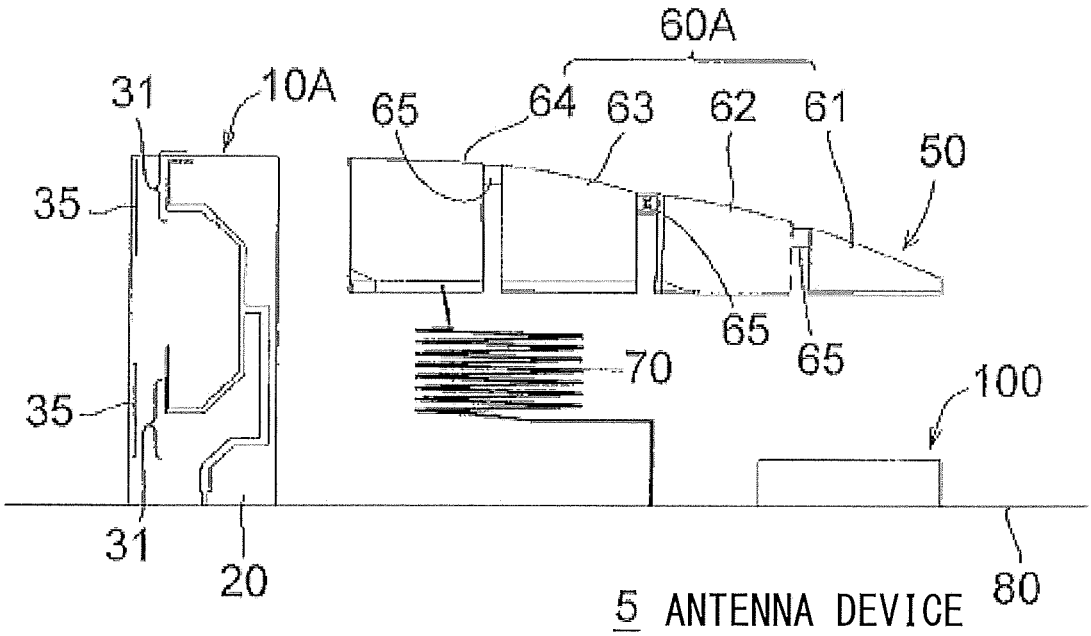
FIG. 25 shows a right side view of the antenna device 5 as viewed frontward.

FIG. 24 shows a left side view of an antenna device 5 according to an embodiment 5 as viewed frontward and FIG. 25 shows a right side view thereof as viewed frontward. The antenna device 5 differs from the antenna device 4 in that the antenna device 5 includes an array antenna substrate 10A having wave directors 35 on the right side face as viewed frontward to correspond individually to the dipole antennas 31. The wave director 35 is a conductor pattern provided for the dielectric body substrate 20 to be positioned in parallel to and spaced apart from the dipole antenna 31 by a predetermined distance. The other structures are similar to those of the embodiment 4.

Figure 26:
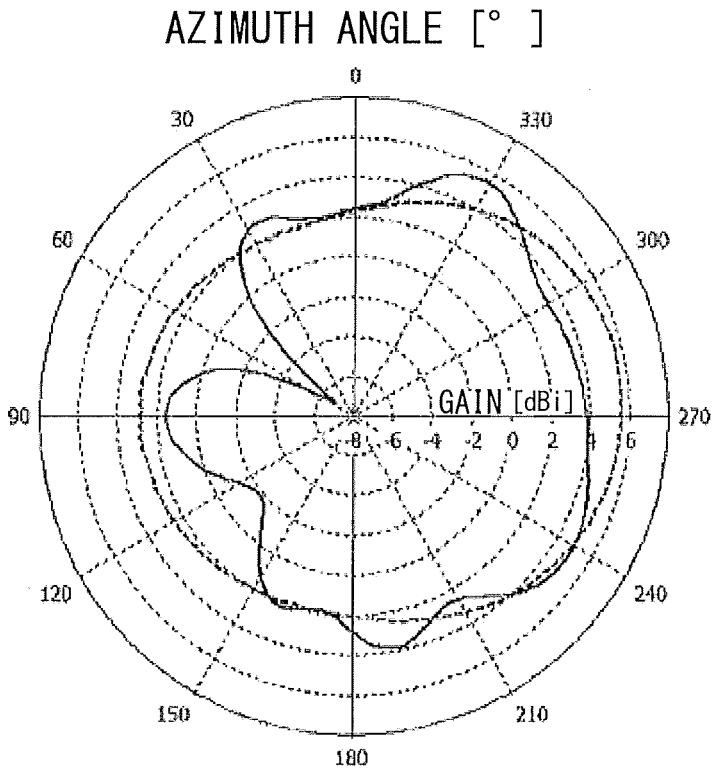
FIG. 26 shows a comparison diagram of directivity characteristic of the antenna device 5 with respect to vertical polarization in the horizontal plane.

FIG. 26 shows a comparison diagram of directivity characteristic of the antenna device 5 in the horizontal plane with respect to vertical polarization; in other words, FIG. 26 shows a characteristic diagram regarding simulation about the change in gain (dBi) of the array antenna substrate 10 in all directions in the horizontal plane with respect to vertical polarization, the simulation is conducted in the case in which the AM/FM broadcast antenna element 50 including the capacitance loading element 60A of the divided structure is provided adjacent to the array antenna substrate 10A in the front direction and in the case in which the AM/FM broadcast antenna element 50 including the capacitance loading element 60A of the divided structure is not present. A solid line indicates the former case and a dashed line indicates the latter case. The frequency is 5887.5 MHz. In FIG. 26, the azimuth angle 90° indicates the front direction and the azimuth angle 270° indicates the rear direction. The azimuth angles 0° to 180° correspond to the front half of the antenna device 5 and the azimuth angles 180° to 360° correspond to the rear half of an antenna device 5. Each kind of directivity characteristic in FIG. 26 shows an example in the case in which a ground conductor (a conductive plate of 1 m in diameter) is provided instead of the antenna base 80 and provided at the position of the antenna base 80 of the antenna device 5.

Figure 27:
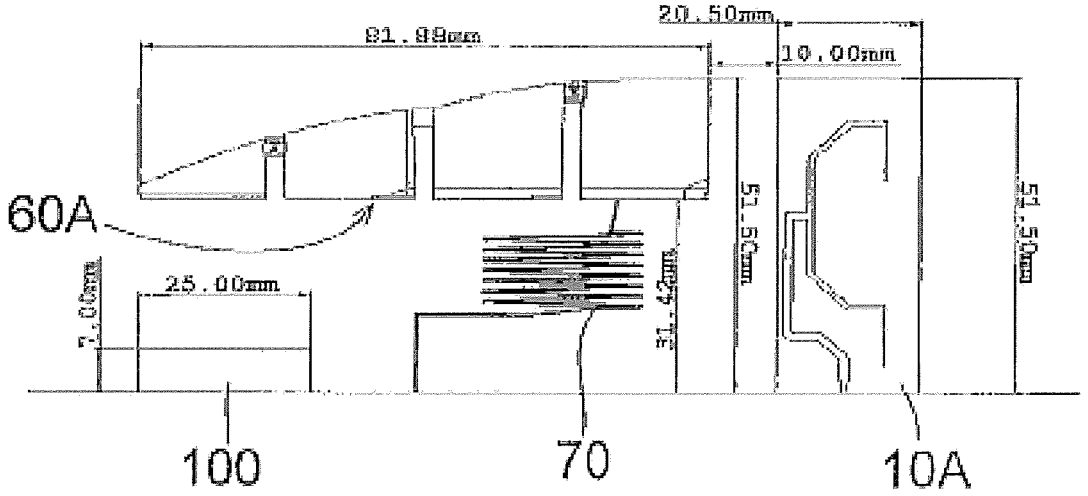
FIG. 27 shows a side view illustrating an arrangement and a dimensional relationship of main constituent members of the antenna device 5.

FIG. 27 shows a side view illustrating an arrangement and a dimensional relationship of main constituent members (the array antenna substrate 10A, the capacitance loading element 60A, the helical element 70, and the patch antenna 100) of the antenna device 5. As illustrated in FIG. 27, the distance between the rearmost end of the capacitance loading element 60A and the rear edge of the array antenna substrate 10A in the front-rear direction is 30.5 mm. However, the positional relationship of the dipole antenna arrays 30 with respect to the front edge of the array antenna substrate 10A is the same as that of the array antenna substrate 10 of the embodiment 4, the distance D between the rearmost end of the capacitance loading element 60A and the dipole antenna arrays 30 in the front-rear direction is approximately 26.5 mm. The distances D corresponds to an approximately ½ wave length of the operating frequency band of the dipole antenna arrays 30.

The directivity characteristic diagram in FIG. 26 illustrates the case in which the distance D is an approximately ½ wave length of the operating frequency band of the dipole antenna arrays 30. When the distance D is within an approximately 1 wave length of the operating frequency band of the dipole antenna arrays 30, the capacitance loading element 60A serves as a reflector in contrast to the case in which the AM/FM broadcast antenna element 50 is not present. Thus, the average gain of the rear half becomes higher than the average gain of the front half with respect to the horizontal plane of the array antenna substrate 10A.

In the case of the antenna device 5, the average gain of the front in the horizontal plane of the array antenna substrate 10A is 0.7 dBi, the average gain of the rear is 3.9 dBi, and accordingly, the difference between the front and the rear is 3.2 dBi. In comparison, when the capacitance loading element 60A of the AM/FM broadcast antenna element 50 is not present, the average gain of the front in the horizontal plane of the array antenna substrate 10A is 2.3 dBi, the average gain of the rear is 4.3 dBi, and accordingly, the difference between the front and the rear is 2.0 dBi.

As described above, concerning the antenna device 5, the average gain in the horizontal plane is higher than the average gain in the horizontal plane of the monopole antenna illustrated in FIG. 28.

As described above, the difference in the average gain between the front half and the rear half in the horizontal plane of the array antenna substrate 10A is relatively great in contrast to the case in which the capacitance loading element 60A is not present. In the case of the antenna device 5, the average gain in the horizontal plane is higher than the average gain in the case of the monopole antenna; since the capacitance loading element 60A serves as a reflector, the average gain of the rear half in the horizontal plane of the array antenna substrate 10A is higher than the average gain of the front half. In addition, since the array antenna substrate 10A includes the wave directors 35, the average gain of the rear half is higher than that of the embodiment 4.

As illustrated in FIG. 25, in the antenna device 5, the wave directors 35 are provided for only the right side face of the array antenna substrate 10A as viewed frontward, but the wave directors 35 may be provided for only the left side face or both sides of the array antenna substrate 10A. In each case, the directivity characteristic is improved as compared to other embodiments.

Embodiment 6

Figure 29:
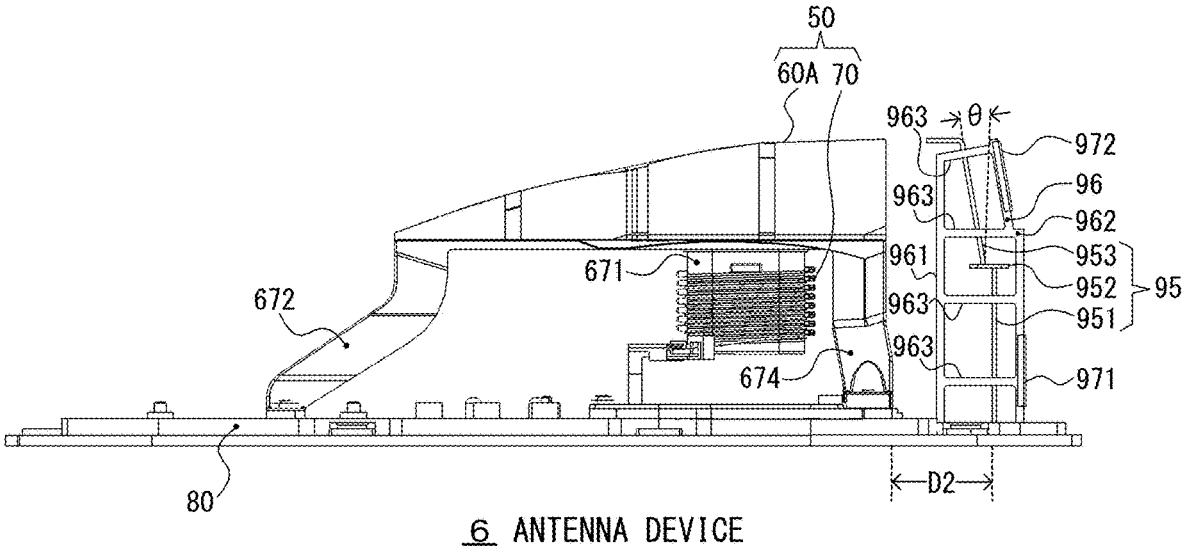
FIG. 29 shows a left side view of an antenna device 6 according to an embodiment 6 as viewed frontward.
Figure 30:
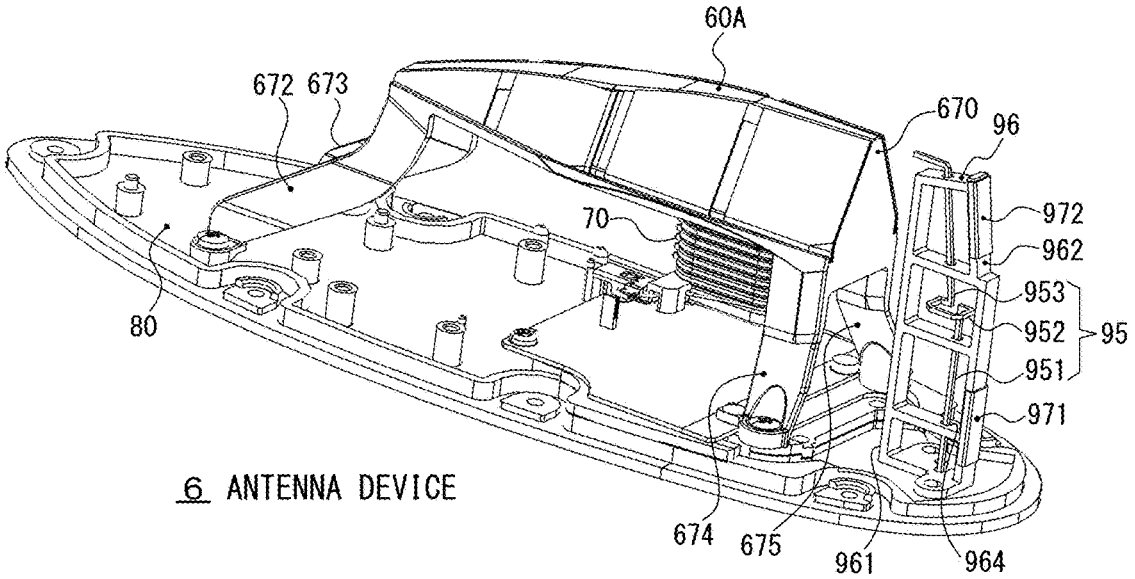
FIG. 30 shows a perspective view of the antenna device 6 as viewed from an upper rear left side.

FIG. 29 shows a left side view of the antenna device 6 according to an embodiment 6 as viewed frontward and FIG. 30 is a perspective view thereof as viewed from an upper rear left side. The front-rear direction and the up-down direction are the same as those in FIG. 1. The antenna device 6 uses the collinear array antenna 95 for V2X communication as the first antenna and the AM/FM broadcast antenna element 50 including the capacitance loading element 60A of the divided structure described in the embodiment 4 and the helical element 70 as the second antenna. The collinear array antenna 95 is positioned adjacent to the rear of the capacitance loading element 60A. When the antenna device 6 is attached to a vehicle, the antenna device 6 is accommodated in a radio wave transmitting antenna case which is not illustrated in the drawings.

The capacitance loading element 60A is fixed to the top face of a resin antenna holder 670 formed in a chevron shape in cross-section. The helical element 70 is supported by a helical holder 671 below the antenna holder 670. The antenna holder 670 is screwed to the antenna base 80 at a pair of front legs 672 and 673 and a pair of rear legs 674 and 675 that are extended respectively leftward and rightward. The helical element 70 is offset either rightward or leftward with respect to the width direction (the transverse direction) of the capacitance loading element 60A, but the helical element 70 may be positioned at substantially the center with respect to the width direction.

The collinear array antenna 95 is constituted by a linear or rod-like element. The collinear array antenna 95 is positioned substantially vertically (that is, in a substantially vertical direction) with respect to the horizontal plane (the plane orthogonal to the direction of gravity) so that a vehicle body serves as a ground conductor plate and the collinear array antenna 95 is vertically polarized suitably for V2X communication when the antenna device 6 is attached to a vehicle body. In the embodiment 6, the collinear array antenna 95 is constituted by a first linear member 951, an annular member 952, and a second linear member 953 that are each a rod-like element formed in a polygon in cross-section.

The first linear member 951 extends upwardly at a first tilt angle (for example, 90 degrees) relative to the antenna base 80. The base end of the first linear member 951 serves as a feeding portion. The second linear member 953 tilts frontward at a second tilt angle (90 degrees+θ) relative to the first linear member 951. An end of the second linear member 953 is bent at a position level with the capacitance loading element 60A. The length of the bended portion is adjusted to a length that does not affect antenna performance of the collinear array antenna 95 due to the bending. This means that the length obtained by straighten the second linear member 953 including the end at an angle identical to that of the first linear member 951 is the same as the length of the second linear member 953 when the second linear member 953 is straight.

The annular member 952 is a spiral element provided between an end of the first linear member 951 and a base end of the second linear member 953 and exists for the purpose of matching the phase of the first linear member 951 and the phase of the second linear member 953.

The collinear array antenna 95 is supported by a resin holder 96 of a frame structure. The holder 96 serves as a dielectric body of the collinear array antenna 95. The holder 96 includes a pair of pillars 961 and 962 each extending in a vertical direction relative to the antenna base 80 and a plurality of connecting portions 963 that connect the pillars 961 and 962 to each other. Holes 964 used for fastening the first linear member 951, the annular member 952, and the second linear member 953 of the collinear array antenna 95 is formed in the connecting portions 963. The holes 964 are formed, for example, such that a potion on a side face of each of the connecting portions 963 is cut close to the center, the collinear array antenna 95 is fitted to the holes 964, and then, the holes 964 are filled with a resin. Alternatively, the holder 96 may be formed while the collinear array antenna 95 is placed on, for example, a mold.

A distance D2 between the first linear member 951 of the holder 96 and the rear end of the capacitance loading element 60A is a distance (a length) that enables the capacitance loading element 60A to serve as a reflector of the collinear array antenna 95, that is, a distance equal to or longer than a ¼ wave length and equal to or less than an approximately 1 wave length of the operating frequency band of the collinear array antenna 95. In the holder 96, a first conductor element 971 is provided on the pillar 962 at the rear of the first linear member 951 in parallel to the first linear member 951. In addition, a second conductor element 972 is provided at the rear of the second linear member 953 in parallel to the second linear member 953. The first conductor element 971 and the second conductor element 972 are each provided to have a size and an interval that enable them to operate as a wave director of the collinear array antenna 95. These conductor elements 971 and 972 improve gain on the rear side of the collinear array antenna 95. Moreover, since the second conductor element 972 tilts on the upper side with respect to the horizontal plane similarly to the second linear member 953, the gain in the tilt direction can be increased.

Figure 31:
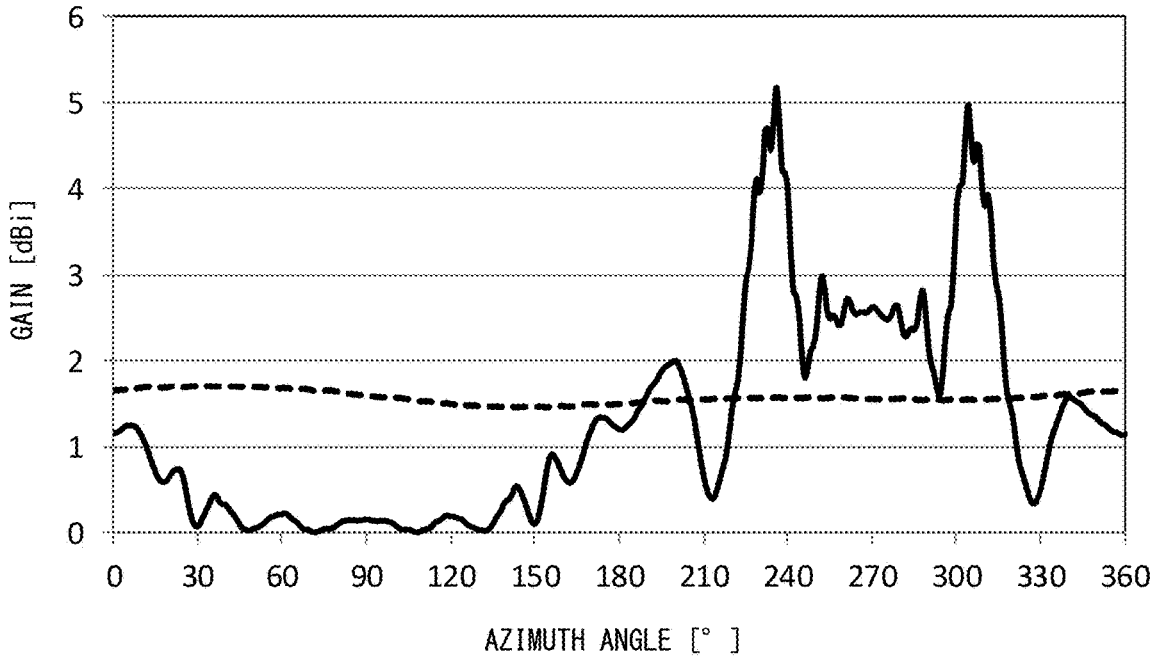
FIG. 31 shows a comparison diagram of directivity characteristic of the antenna device 6 with respect to vertical polarization in the horizontal plane.

FIG. 31 shows a comparison diagram of directivity characteristic of the antenna device 6 in the horizontal plane with respect to vertical polarization; in other words, FIG. 31 shows a characteristic diagram regarding simulation about the change in gain (dBi) of the array antenna substrate 10 in all directions in the horizontal plane with respect to vertical polarization, the simulation is conducted in the case in which the capacitance loading element 60A of the AM/FM broadcast antenna element 50 is provided adjacent to the collinear array antenna 95 in the front direction and in the case in which the capacitance loading element 60A of the AM/FM broadcast antenna element 50 is not present. A solid line indicates the former case and a dashed line indicates the latter case. The frequency is 5887.5 MHz, at which the collinear array antenna 95 operates.

In FIG. 31, the azimuth angle 90° indicates the front direction and the azimuth angle 270° indicates the rear direction. The azimuth angles 0° to 180° correspond to the front half of the antenna device 6 and the azimuth angles 180° to 360° correspond to the rear half of the antenna device 6. Each kind of directivity characteristic in FIG. 31 shows an example in the case in which a ground conductor (a conductive plate of 1 m in diameter) is provided instead of the antenna base 80 and provided at the position of the antenna base 80 of the antenna device 5.

When the capacitance loading element 60A is not present in front of the collinear array antenna 95, the average gain of the front half of the collinear array antenna 95 is 2.0 dBi, the average gain of the rear half is 2.0 dBi, and accordingly, there is no difference between the front half and the rear half. When the first conductor element 971 and the second conductor element 972 are not present, the average gain of the front half of the collinear array antenna 95 is 1.2 dBi, the average gain of the rear half is 2.2 dBi, and accordingly, the difference between the front half and the rear half is 1.0 dBi. Thus, as indicated by the dashed line in FIG. 31, the average gain is at a fixed level in all directions.

In the antenna device 6, for the collinear array antenna 95, the capacitance loading element 60A serves as a reflector and the first conductor element 971 and the second conductor element 972 serve as wave directors. Thus, as indicated by the solid line in FIG. 31, the average gain of the front half (the azimuth angles 0° to) 180° is 0.39 dBi. In the rear half (the azimuth angles 180° to 270°), the gain is 0.39 dBi at 213°, 5.17 dBi at 236°, 4.97 dBi at 306°, and 0.34 dBi at 329°, and accordingly, the average gain of the rear half is 2.17 dBi.

As described above, not only the difference between the average gain of the front half and the average gain of the rear half is greater but also the average gain of the rear half is higher than the average gain of the front half.

In the embodiment 6, the end portion of the second linear member 953 of the collinear array antenna 95 is bent. As a result, the height of the collinear array antenna 95 can be lowered and the antenna device 6 is formed in low-profile. Furthermore, since the collinear array antenna 95 is formed in a rod-like shape, the cost can be reduced in comparison to the case in which the collinear array antenna 95 is printed on a dielectric body substrate or the like.

Embodiment 7

Figure 32:
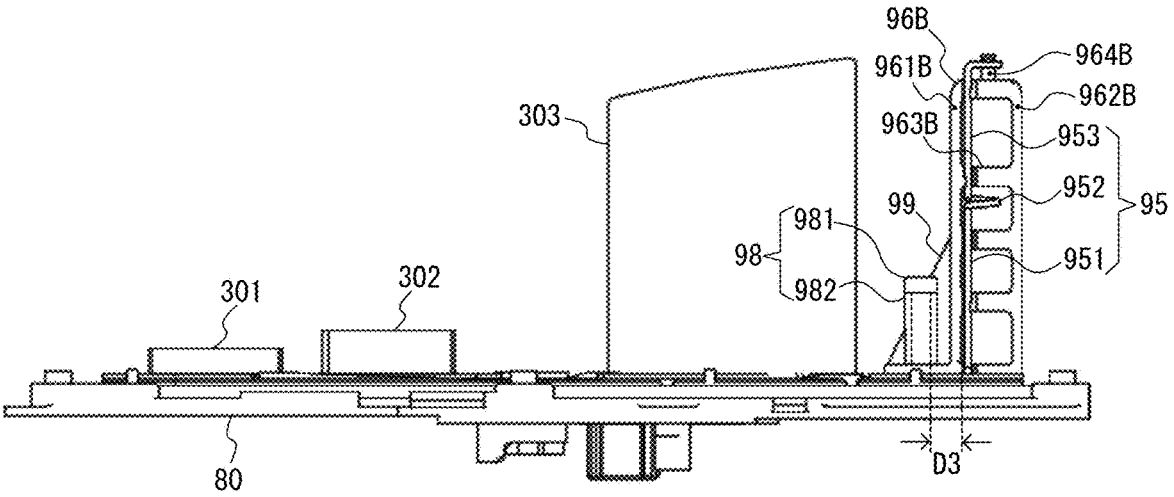
FIG. 32 shows a left side view of an antenna device 7 according to an embodiment 7 as viewed frontward.

FIG. 32 shows a left side view of an antenna device 7 according to an embodiment 7 as viewed frontward.

An antenna device 7 is constituted by a satellite broadcasting antenna 301, a satellite navigation system antenna 302, an LTE antenna 303, and the collinear array antenna 95 that are disposed in this order from the front to the rear on the antenna base 80. When the antenna device 7 is attached to a vehicle, the antenna device 7 is accommodated in a radio wave transmitting antenna case which is not illustrated in the drawings. In the antenna device 7, constituent members identical to those described in the embodiments 1 to 6 are assigned the same reference characters and the detailed description thereof is omitted.

The satellite broadcasting antenna 301 is an antenna for reception of satellite broadcasting. The satellite navigation system antenna 302 is an antenna for reception in a satellite navigation system. The LTE antenna 303 is an antenna that operates at any frequency band corresponding to LTE (Long Term Evolution).

The LTE antenna 303 includes a plate-like conductor having an edge facing the collinear array antenna 95 similarly to the capacitance loading elements 60 and 60A. The plate-like conductor is substantially the same in height as the capacitance loading elements 60 and 60A. The distance between the collinear array antenna 95 and the closest edge of the plate-like conductor is an approximately 1 wave length of the operating frequency of the collinear array antenna 95. Thus, the LTE antenna 303 also operates as a reflector of the collinear array antenna 95.

While the collinear array antenna 95 is functionally the same as the one described in the embodiment 6, the collinear array antenna 95 differs from the embodiment 6 in that the shape of the annular member 952 in the flat plane is circular, that the first linear member 951 and the second linear member 953 are positioned in a line (not tilted) vertical to the antenna base 80, and that the end of the second linear member 953 is directed not frontward but rearward.

The collinear array antenna 95 is attached to a resin holder 96B screwed to the antenna base 80 with an attachment 98.

The holder 96B includes a pair of two pillars 961B and 962B each extending in a vertical direction relative to the antenna base 80 and a plurality of connecting portions 963B that connects the pillars 961B and 962B to each other. A protruding member 964B used for fastening the end of the collinear array antenna 95 (the second linear member 953) is provided at the upper end of the holder 96B. The protruding member 964B is a fit-type resin hook formed, for example, such that part of a hollow cylinder is open and the protruding member 964B is formed integrally with the holder 96B. The protruding member 964B is used for, for example, positioning when a worker assembles the antenna and the protruding member 964B hinders displaced installation of the collinear array antenna 95 and posterior deformation due to external force.

The attachment 98 includes a metal body covered by a resin protective material 982 such as a metal screw 981. The metal screw 981 is positioned in parallel to the first linear member 951 of the collinear array antenna 95. The electrical length of the metal screw 981 in the vertical direction is configured to be slightly longer than a ¼ wave length of the operating frequency band of the collinear array antenna 95. As an example, the electrical length is configured to be an approximately 1.1 wave length of the operating frequency band of the collinear array antenna 95. As a result, the metal screw 981 serves as a reflector of the collinear array antenna 95. Moreover, the metal screw 981 also serves as a fitting means for attaching the collinear array antenna 95 to the antenna base 80, and thus, the number of members of the antenna device 7 can be reduced.

The holder 96B and the attachment 98 are reinforced by a resin reinforcing member 99 which is an example of a dielectric body. The shape and the size of the reinforcing member 99 can be adjusted to any dimensions within a range that enables the reinforcing member 99 to be accommodated in the antenna case described above. Since the strength is reinforced by the reinforcing member 99, the holder 96B can be formed in any shape. For example, the length in the front-rear direction can be reduced as compared to the holder 96 used in the embodiment 6.

The space between the pillar 961B of the holder 96B and the protective material 982 of the attachment 98 is filled with a dielectric body (the reinforcing member 99); in other words, the dielectric body is interposed between the collinear array antenna 95 and the attachment 98. By using the holder 96B, the protective material 982, and the reinforcing member 99, the effect of shortening the wave length of the collinear array antenna 95 due to the dielectric body occurs, and result, the height of the collinear array antenna 95 is lowered and the antenna device 7 is consequently formed in low-profile. Furthermore, due to the effect of shortening the wave length of the collinear array antenna 95, the wave length of the operating frequency band of the collinear array antenna is reduced. For example, a 1 wave length at 5.9 GHz is approximately 52.0 mm, but the 1 wave length is decreased to approximately 14.0 mm to 22.0 mm due to the effect of shortening the wave length.

Figure 33:
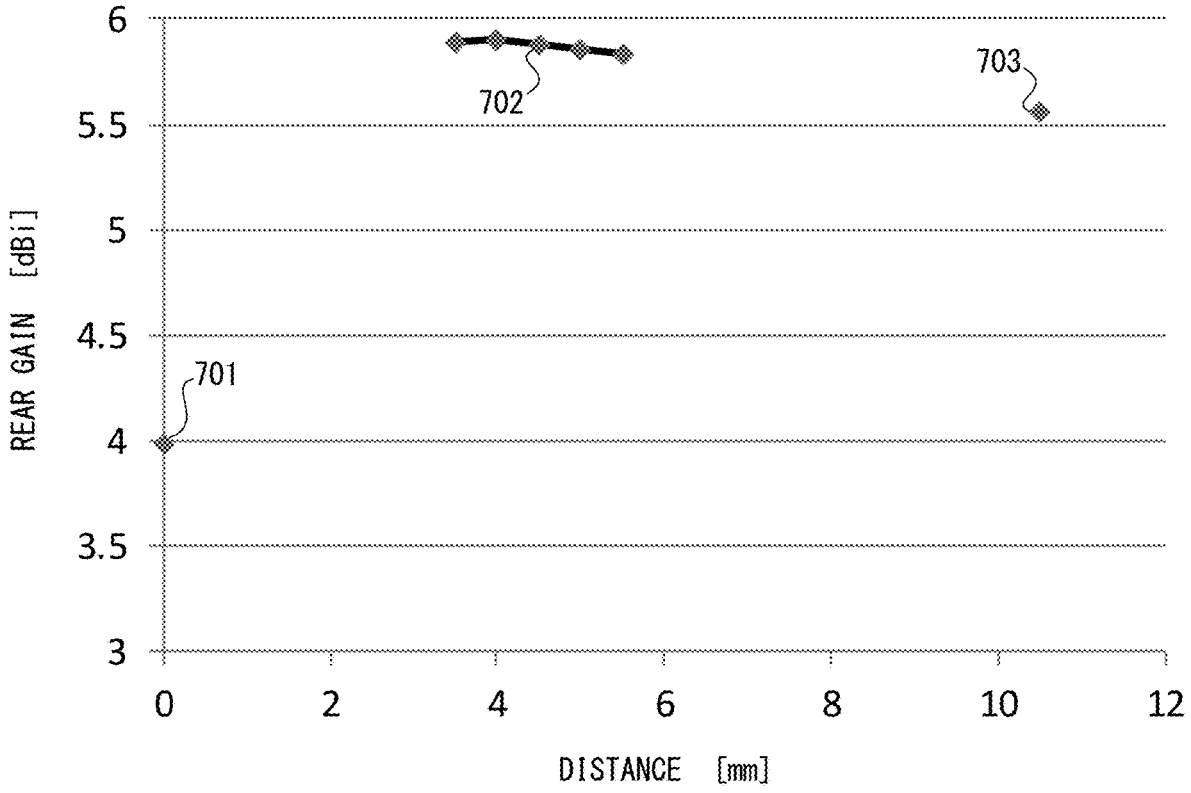
FIG. 33 shows a rear gain characteristic diagram in accordance with a distance between an antenna and a metal body of the antenna device 7.

A distance D3 between the collinear array antenna 95 (the first linear member 951) and the metal screw 981 is a distance that enables the attachment 98 to serve as a reflector of the collinear array antenna 95. For example, the distance D3 is equal to or longer than a ¼ wave length and equal to or shorter than an approximately 1 wave length of the operating frequency band of the collinear array antenna 95. FIG. 33 illustrates an example of rear gain characteristic in a horizontal direction with respect to vertical polarization in the antenna device 7 in the case of the distance D3. In FIG. 33, the vertical axis indicates the rear-side gain at 5887.5 MHz frequency, that is, the gain (dBi) in a direction)(180° opposite to the metal screw 981 with respect to the collinear array antenna 95. The horizontal axis in FIG. 33 indicates the distance D3 mm. The distance D3 of 0 mm represents the case in which the metal screw 981 is not present. FIG. 33 shows an example in the case in which a ground conductor (a conductive plate of 1 m in diameter) is provided instead of the antenna base 80 and provided at the position of the antenna base 80 of the antenna device 7.

Referring to FIG. 33, a rear gain 701 is approximately 4 dBi when the distance D3 is 0 mm, a rear gain 702 is approximately 5.9 dBi when the distance D3 is 3.5 mm to 5.5 mm (for example, an approximately ¼ wave length of the operating frequency band), and a rear gain 703 is approximately 5.56 dBi when the distance D3 is 10.5 mm (for example, an approximately ½ wave length of the operating frequency band). It is understood that, when the distance D3 is within an approximately 1 wave length of the operating frequency band, the gain of the antenna element in the 180° direction is improved.

This is because the metal screw 981 serves as a reflector of the collinear array antenna 95, and therefore, when the satellite broadcasting antenna 301, the satellite navigation system antenna 302, the LTE antenna 303, or the like are accommodated together in front of the collinear array antenna 95 in the antenna case, it is possible to suppress interference between these antennas and the collinear array antenna 95.

Embodiment 8

Figure 34A:
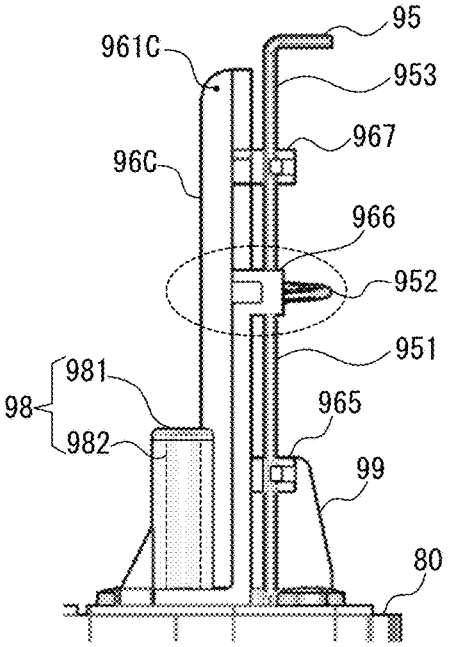
FIG. 34A shows a left side partial view of an antenna device 8 according to an embodiment 8 as viewed frontward.

FIG. 34A shows a left side partial view of an antenna device 8 according to an embodiment 8 as viewed frontward. The antenna device 8 differs from the antenna device 7 indicated in the embodiment 7 in the structure of the part at which the collinear array antenna 95 is held. Specifically, the antenna device 8 includes a holder 96C of a simple structure which serves as a dielectric body. The attachment 98 (the metal screw 981 and the protective material 982) and the reinforcing member 99 that are used for attaching and fixing the holder 96C to the antenna base 80 are the same as those described in the embodiment 7.

The holder 96C has one pillar 961C. A first hook 965 for fastening part of the first linear member 951 of the collinear array antenna 95, a supporting member 966 for supporting the annular member 952, and a second hook 967 for fastening part of the second linear member 953 are integrally provided for the pillar 961C. The first hook 965 and the second hook 967 have respective protruding bodies that parallelly protrude from the pillar 961C toward the rear side, the protruding bodies each having a base end at one side thereof and a free end (an end portion having an open end; the same shall apply hereinafter) extending from the base end and bending back in a direction toward the base end while holding the collinear array antenna 95. The free end is made of a resin, and thus, the free end elastically holds the collinear array antenna 95.

Figure 34B:
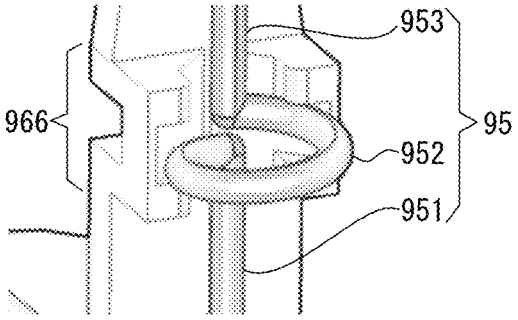
FIG. 34B shows a partial perspective view of the structure of a supporting member supporting an annular member as viewed from a rear side.

The supporting member 966 has a protruding body that protrudes rearward from the pillar 961C and that has substantially cruciform groove formed by cutting off a portion that would contact with the annular member 952. FIG. 34B shows a partial perspective view of the supporting member 966 indicated by a dashed line in FIG. 34A as viewed from the rear side. In the substantially cruciform groove of the supporting member 966, the area close to the center of a groove in the substantially horizontal direction is the deepest and the area close to the end portion of the groove is shallow. The groove accommodates one side of the outer circumference of the spiral portion of the annular member 952. In the substantially cruciform groove, a groove in the vertical direction accommodates part of the first linear member 951 and part of the second linear member 953 that are integral with the annular member 952. The accommodated parts are freely fitted to the groove.

Concerning the collinear array antenna 95, the first linear member 951 and the second linear member 953 are elastically held respectively by the first hook 965 and the second hook 967 pushing the first linear member 951 and the second linear member 953 from the rear side to the front side and the annular member 952 is supported by the supporting member 966 in a freely fitted manner. As a result, the holder 96C can fasten the collinear array antenna 95 without being affected by vibration caused while the vehicle drives. Since the holder 96C supports the collinear array antenna 95 by using the one pillar 961C, it is possible to realize the antenna device 8 the length of which in the front-rear direction is shorter than the holder including two pillars as in the embodiments 6 and 7. Since the strength of the holder 96C is reinforced by the reinforcing member 99, it is possible to realize the antenna device 8 the width of which in the transverse direction decreases toward the upper side in contrast to the case in which the reinforcing member 99 is not present.

Modifications

While the embodiments 7 and 8 describe an example in which the LTE antenna 303 is provided in front of the collinear array antenna 95, the capacitance loading elements 60 and 60A may be provided instead of the LTE antenna 303. In this case, the capacitance loading elements 60 and 60A also serve as reflectors of the collinear array antenna 95. Alternatively, instead of the LTE antenna 303, an antenna for a cellular phone of 814 to 894 MHz (B26 band) or 1920 MHz (B1 band) may be provided. Furthermore, a dielectric body substrate may be provided at the rear of the collinear array antenna 95 and a conductor element may be formed on the dielectric body substrate which serves as a wave director. Moreover, also in the sleeve antenna 90 of the embodiment 2, a similar dielectric body substrate may be provided.

Further, in the embodiments 7 and 8, the antenna device may be constituted by only the collinear array antenna 95, the holder 96 (96B, 96C), and the attachment 98.

Moreover, the attachment 98 may be positioned on the rear side of the collinear array antenna 95 and the attachment 98 may be caused to serve as a wave director. In this case, the electrical length of the metal screw 981 of the attachment 98 is configured to be shorter than a 1 wave length of the operating frequency band of the collinear array antenna 95. For example, the electrical length may be an approximately 0.9 wave length.

Furthermore, the attachment 98 may be provided on both the front and rear sides of the collinear array antenna 95 and the attachment 98 on the front side may be caused to serve as a reflector and the other attachment on the rear side as a wave director. To cause the attachment 98 to operate as a wave director, the electrical length of the metal screw 981 and the distance to the collinear array antenna 95 can be the same as those of the second conductor element 972.

As described in the above, according to the present disclosure, an antenna device for a vehicle is provided. In the antenna device, improved gain in a predetermined direction is obtained by setting the average gain in one direction so as to be higher than those in other directions.

While the embodiments describe an example in which the capacitance loading elements 60 and 60A are both plate-like conductive components without a cutout or a slit, a conductive component in a shape including a cutout or a slit or a meander shape.

According to the above-described embodiments and modifications, the following aspects of the present invention can also be described.

One aspect of the present invention is an antenna device for a vehicle including: an antenna base to be attached to the vehicle; and a first antenna and a second antenna, each operates in different frequency bands, on the antenna base, in which second antenna may serve as a reflector of the first antenna in an operating frequency band of the first antenna.

The first antenna and the second antenna may be spaced apart from each other by a distance within a 1 wave length of the operating frequency band of the first antenna.

The second antenna may include a plate-like conductor having an edge facing the first antenna. The distance may be a distance from the first antenna to the edge of the second antenna and the edge may be closest to the first antenna.

The antenna device for the vehicle may include a patch antenna that operates in a frequency band different from a frequency band of the first antenna and a frequency band of the second antenna, in which the second antenna may be provided between the first antenna and the patch antenna.

The first antenna may be any of an array antenna substrate including a plurality of dipole antenna arrays to which power can be simultaneously fed, a sleeve antenna, and a collinear array antenna.

A conductor element which serves as a wave director may be provided at a position apart from the first antenna by a predetermined distance.

The conductor element may be formed by a conductor pattern formed on an insulating substrate provided on the antenna base.

The first antenna may be a collinear array antenna. An antenna element of the collinear array antenna may be constituted by a linear or rod-like conductor and held together with the conductor element by a holder positioned on the antenna base.

The antenna element of the collinear array antenna may be held by the holder at a plurality of tilt angles relative to the antenna base. A plurality of the conductor elements may be included and the conductor elements may be held by the holder in parallel to respective tilts of the antenna element.

The holder may include a plurality of pillars extending in a vertical direction relative to the antenna base and a connecting portion connecting the plurality of pillars to each other, and the collinear array antenna may be elastically held by one of the plurality of pillars or the connecting portion.

The holder may include a pillar extending in a vertical direction relative to the antenna base, and the conductor element may be provided for at least part of the pillar.

Another aspect of the present invention is an antenna device for a vehicle, including: an antenna base to be attached to the vehicle; a first antenna for a first frequency band provided on the antenna base; and a second antenna for a second frequency band provided-on the antenna base, in which the first frequency band and the second frequency band are different from each other, and the second antenna serves as a reflector of the first antenna in the first frequency band of the first antenna.

The first antenna and the second antenna may be spaced apart from each other by a distance within a 1 wave length of the first frequency band of the first antenna.

The second antenna may include a plate-like conductor having an edge facing the first antenna, and in which the distance may be a distance from the first antenna to the edge of the second antenna, the edge being closest to the first antenna.

The antenna device for the vehicle may further include: a patch antenna for a third frequency band which is different from a first frequency band of the first antenna and the second frequency band of the second antenna, in which the second antenna may be provided between the first antenna and the patch antenna.

The first antenna may be any of an array antenna substrate including a plurality of dipole antenna arrays to which power can be simultaneously fed, a sleeve antenna, and a collinear array antenna.

A conductor element which serves as a wave director may be provided at a position apart from the first antenna by a predetermined distance.

The conductor element may be formed by a conductor pattern formed on an insulating substrate provided on the antenna base.

The first antenna may be a collinear array antenna, and in which an antenna element of the collinear array antenna may be constituted by a linear or rod-like conductor and held together with the conductor element by a holder positioned on the antenna base.

The antenna element of the collinear array antenna may be held by the holder at a plurality of tilt angles relative to the antenna base, in which a plurality of the conductor elements may be included, and the conductor elements may be held by the holder in parallel to respective tilts of the antenna element.

The holder may include a pillar extending in a vertical direction relative to the antenna base and a connecting portion connecting to the pillar, and the collinear array antenna may be elastically held by at least one of the pillar and the connecting portion.

The holder may include a pillar extending in a vertical direction relative to the antenna base, and the conductor element may be provided for at least part of the pillar.

The antenna device for the vehicle may further include an attachment used for attaching the holder to the vehicle, in which the attachment may include a metal body, and the metal body may serve as a reflector or a wave director of the collinear array antenna in an operating frequency band of the collinear array antenna.

A dielectric body is provided between the collinear array antenna and the metal body.

Another aspect of the present invention is an antenna device to be attached to a vehicle including: an antenna base to be attached to the vehicle; an antenna element provided on the antenna base; a holder to be attached to the antenna base; and an attachment used for attaching the holder to the vehicle, in which an antenna element may be held by the holder, the attachment may include a metal body positioned substantially in parallel to the antenna element, and the metal body may serve as a reflector or a wave director of the antenna element in an operating frequency band of the antenna element.

A dielectric body may be provided between the antenna element and the metal body.

According to the above-described aspects of the present invention, it is possible to provide an antenna device for a vehicle in which, in the case of including a plurality of antennas, one of the plurality of antennas can be configured to improve gain in a predetermined direction by setting the average gain in one direction so as to be higher than those in other directions.

What is claimed is:

1. An antenna device for a vehicle, comprising:

an antenna base to be attached to the vehicle;

a first antenna for a first frequency band provided on the antenna base; and a second antenna for a second frequency band provided on the antenna base, wherein the first frequency band and the second frequency band are different from each other, and the second antenna serves as a reflector of the first antenna in the first frequency band of the first antenna.

2. The antenna device for the vehicle according to claim 1, wherein the first antenna and the second antenna are spaced apart from each other by a distance within a 1 wave length of the first frequency band of the first antenna.

3. The antenna device for the vehicle according to claim 2, wherein the second antenna includes a plate-like conductor having an edge facing the first antenna, and wherein the distance is a distance from the first antenna to the edge of the second antenna, the edge being closest to the first antenna.

4. The antenna device for the vehicle according to claim 1, further comprising:

a patch antenna for a third frequency band which is different from a first frequency band of the first antenna and the second frequency band of the second antenna, wherein the second antenna is provided between the first antenna and the patch antenna.

5. The antenna device for the vehicle according to claim 1, wherein the first antenna is any of an array antenna substrate including a plurality of dipole antenna arrays to which power can be simultaneously fed, a sleeve antenna, and a collinear array antenna.

6. The antenna device for the vehicle according to claim 1, wherein a conductor element which serves as a wave director is provided at a position apart from the first antenna by a predetermined distance.

7. The antenna device for the vehicle according to claim 6, wherein the conductor element is formed by a conductor pattern formed on an insulating substrate provided on the antenna base.

8. The antenna device for the vehicle according to claim 6, wherein the first antenna is a collinear array antenna, and wherein an antenna element of the collinear array antenna is constituted by a linear or rod-like conductor and held together with the conductor element by a holder positioned on the antenna base.

9. The antenna device for the vehicle according to claim 8, wherein the antenna element of the collinear array antenna is held by the holder at a plurality of tilt angles relative to the antenna base, wherein a plurality of the conductor elements is included, and wherein the conductor elements are held by the holder in parallel to respective tilts of the antenna element.

10. The antenna device for the vehicle according to claim 8, wherein the holder includes a pillar extending in a vertical direction relative to the antenna base and a connecting portion connecting to the pillar, and wherein the collinear array antenna is elastically held by at least one of the pillar and the connecting portion.

11. The antenna device for the vehicle according to claim 8, wherein the holder includes a pillar extending in a vertical direction relative to the antenna base, and wherein the conductor element is provided for at least part of the pillar.

12. An antenna device to be attached to a vehicle, comprising:

an antenna base to be attached to the vehicle;

an antenna element provided on the antenna base;

a holder to be attached to the antenna base; and an attachment used for attaching the holder to the vehicle, wherein the antenna element is held by the holder, wherein the attachment includes a metal body positioned substantially in parallel to the antenna element, and wherein the metal body serves as a reflector or a wave director of the antenna element in an operating frequency band of the antenna element.

13. The antenna device to be attached to the vehicle according to claim 12, wherein a dielectric body is provided between the antenna element and the metal body.

* * * * *